US011536179B2

(12) United States Patent
Datz et al.

(10) Patent No.: US 11,536,179 B2
(45) Date of Patent: Dec. 27, 2022

(54) EXHAUST GAS TREATMENT ASSEMBLY UNIT

(71) Applicant: Purem GmbH, Neunkirchen (DE)

(72) Inventors: Wolfgang Datz, uml u+ee bingen (DE); Markus Henzler, Grafenberg (DE); Peter Kast, Esslingen (DE)

(73) Assignee: PUREM GMBH, Neunkirchen (DE)

( * ) Notice: Subject to any disclaimer, the term of this patent is extended or adjusted under 35 U.S.C. 154(b) by 0 days.

(21) Appl. No.: 16/986,618

(22) Filed: Aug. 6, 2020

(65) Prior Publication Data

US 2021/0040874 A1 Feb. 11, 2021

(30) Foreign Application Priority Data

Aug. 8, 2019 (DE) ..... 10 2019 121 411.4

(51) Int. Cl.
*F01N 13/18* (2010.01)
*F01N 3/28* (2006.01)

(52) U.S. Cl.
CPC ..... *F01N 3/28* (2013.01); *F01N 13/1805* (2013.01); *F01N 13/1844* (2013.01); *F01N 2450/18* (2013.01)

(58) Field of Classification Search
CPC ..... F01N 13/1805; F01N 13/1844; F01N 2450/18; F16L 9/18
USPC ..... 60/282; 138/108, 112, 113, 114
See application file for complete search history.

(56) References Cited

U.S. PATENT DOCUMENTS

| | | | | |
|---|---|---|---|---|
| 10,132,226 | B2 * | 11/2018 | Vyelyayev | F01N 3/2878 |
| 2007/0186546 | A1 | 8/2007 | Midgley et al. | |
| 2011/0035903 | A1 * | 2/2011 | Sims | B62D 25/10 16/293 |
| 2014/0007562 | A1 | 1/2014 | Justin | |
| 2015/0107458 | A1 * | 4/2015 | Werni | F01N 3/0217 96/380 |

(Continued)

FOREIGN PATENT DOCUMENTS

| | | | |
|---|---|---|---|
| CN | 101688452 | A | 3/2010 |
| CN | 105804839 | A | 7/2016 |
| CN | 106103964 | A | 11/2016 |

(Continued)

*Primary Examiner* — Devon C Kramer
*Assistant Examiner* — Kelsey L Stanek
(74) *Attorney, Agent, or Firm* — McGlew and Tuttle, P.C.

(57) ABSTRACT

An exhaust gas treatment assembly unit for an exhaust system of an internal combustion engine includes a tubular outer housing (12) elongated in a direction of an outer housing longitudinal axis ($L_A$), a tubular inner housing (14) elongated in the direction of an inner housing longitudinal axis ($L_I$), an exhaust gas treatment unit (16) being carried in the inner housing (14), and a locking fixing device (24) detachably fixing the inner housing in the outer housing. The locking fixing device (24) includes a locking fixing element (26) held at the inner housing (14) in both axial directions with a radially outwards prestressed locking meshing area (28). In association with the locking meshing area (28), a locking receiving area (42) at the outer housing (12), interacts with the locking meshing area (28) for holding the inner housing (14) in the outer housing (12) in at least one axial direction.

12 Claims, 20 Drawing Sheets

(56) References Cited

U.S. PATENT DOCUMENTS

2015/0267586 A1 9/2015 Smith et al.

FOREIGN PATENT DOCUMENTS

| | | | | | |
|---|---|---|---|---|---|
| DE | 10349527 | A1 | | 5/2005 | |
| DE | 10357953 | A1 | | 7/2005 | |
| DE | 102009024534 | A1 | | 12/2010 | |
| DE | 102016202056 | B3 | | 3/2017 | |
| EP | 3098405 | A1 | | 11/2016 | |
| JP | S50 6835 | U | | 1/1975 | |
| JP | 50-109013 | A | | 9/1975 | |
| JP | H01125860 | A | | 3/1977 | |
| JP | S62284915 | A | | 12/1987 | |
| JP | S5233427 | A | | 5/1989 | |
| JP | H10337 | A | * | 1/1998 | |
| JP | H10337 | A | | 1/1998 | |
| JP | 2004-509264 | A | | 3/2004 | |
| JP | 2005524798 | A | | 8/2005 | |
| JP | 2012071743 | A | | 4/2012 | |
| JP | 2017002899 | A | | 1/2017 | |
| JP | 2017002899 | A | * | 1/2017 | ..... F01N 13/1888 |
| RU | 2015146208 | A | | 5/2017 | |
| WO | 0223021 | A1 | | 3/2002 | |
| WO | 2014081375 | A1 | | 5/2014 | |

* cited by examiner

EXHAUST GAS TREATMENT ASSEMBLY UNIT

CROSS REFERENCE TO RELATED APPLICATIONS

This application claims the benefit of priority under 35 U.S.C. § 119 of German Application DE 10 2019 121 411.4, filed Aug. 8, 2019, the entire contents of which are incorporated herein by reference.

TECHNICAL FIELD

The present invention pertains to an exhaust gas treatment assembly unit for an exhaust system of an internal combustion engine, comprising a tubular outer housing elongated in the direction of an outer housing longitudinal axis and a tubular inner housing elongated in the direction of an inner housing longitudinal axis, wherein an exhaust gas treatment unit is carried in the inner housing. Such an exhaust gas treatment unit may be, for example, a catalytic converter or a particle filter.

SUMMARY

An object of the present invention is to configure such an exhaust gas treatment assembly unit such that replacement of the exhaust gas treatment unit can be carried out in a simple manner.

This object is accomplished according to the present invention by an exhaust gas treatment assembly unit for an exhaust system of an internal combustion engine, comprising:

- a tubular outer housing elongated in the direction of an outer housing longitudinal axis,
- a tubular inner housing elongated in the direction of an inner housing longitudinal axis, wherein an exhaust gas treatment unit is carried in the inner housing,
- a locking fixing device for the detachable fixing of the inner housing in the outer housing, wherein the locking fixing device comprises:

- at least one locking fixing element held at the inner housing in both axial directions with at least one, radially outwards prestressed locking meshing area, and
- in association with the at least one locking meshing area of the at least one locking fixing element, a locking receiving area interacting with the locking meshing area for holding the inner housing in the outer housing in at least one axial direction at the outer housing.

There is a locking connection brought about by the locking fixing device between the outer housing and the inner housing in the configuration according to the present invention of the exhaust gas treatment unit. This connection can be severed easily and generally without the use of tools and without the need to have to apply strong forces.

In a configuration that can be embodied in a simple manner, the locking receiving area may comprise a radially inwardly open locking depression extending in at least some areas in the circumferential direction about the outer housing longitudinal axis. In particular, provisions may be made in this connection for the locking receiving area to comprise a groove-like (groove) locking depression extending without interruptions in the circumferential direction about the outer housing longitudinal axis.

In an alternative embodiment that also supports the specification of a defined rotary positioning of the inner housing with respect to the outer housing, the locking receiving area may comprise a plurality of locking depressions, which follow each other in the circumferential direction about the outer housing longitudinal axis and are arranged at circumferentially spaced locations from one another.

A plurality of locking meshing areas arranged at spaced locations from one another in the circumferential direction about the inner housing longitudinal axis may be provided at a locking fixing element for a configuration that can be embodied with a small number of components. In this connection, in adaptation to the outer housing and to the inner housing, the locking fixing element has a preferably ring-shape configuration.

Since the outer housing and the inner housing have, in general, a tubular configuration each, the locking fixing element may comprise a ring body extending in the circumferential direction about the inner housing longitudinal axis along an inner side of the inner housing and a plurality of locking meshing areas arranged at circumferentially spaced locations from one another and projecting radially outwards with respect to the ring body, wherein a passage opening, through which the locking meshing area passes such that the locking meshing area projects over an outer side of the inner housing for meshing with an associated locking receiving area, is provided in association with each locking meshing area projecting radially outwards from the ring body in the inner housing. Such a configuration is shown, for example, in FIGS. 1-4.

To obtain a ring-shape configuration, which can easily be embodied, the locking fixing element may be configured as a wire ring. Further, the locking fixing element may be interrupted in the circumferential direction and have circumferential ends arranged at circumferentially spaced locations from one another for an assembly that can be carried out in a simple manner.

A plurality of locking fixing elements following one another in the circumferential direction about the inner housing longitudinal axis may be provided in an alternative embodiment. Such embodiments with a plurality of locking fixing elements configured as separate components are shown, for example, in FIGS. 6-35.

In order to guarantee stable holding at the inner housing, on the one hand, and to make it possible to embody the locking meshing with the outer housing, on the other hand, it is proposed that a holding area holding the locking fixing element in both axial directions at the inner housing be provided at each locking fixing element, and that the locking fixing element comprise at least one locking meshing area projecting radially outwards with respect to the holding area. Such embodiments are shown, for example, in FIGS. 6-35.

The holding area may comprise at least one holding section, preferably two holding sections arranged at spaced locations from one another in the circumferential direction about the inner housing longitudinal axis for a holding interaction that can easily be established between the holding area and the inner housing. Related embodiments are shown, for example, in FIGS. 6-35.

The number of components to be used can be kept low even in case of an embodiment with a plurality of locking fixing elements if at least one and preferably each holding section comprises a holding element provided integrally at the locking fixing element. FIGS. 6-13 and 20-35 show, for example, such embodiments.

In order to make it possible to adapt the exhaust gas treatment assembly unit according to the present invention for different intended uses in a simple manner, it is proposed that at least one and preferably each holding section comprise a holding element configured separately from the locking fixing element. Such embodiments are shown, for example, in FIGS. 14-19.

A stable holding effect can be achieved in a simple manner by one holding section and preferably each holding section comprising a holding element extending around and/or passing through the inner housing. Related embodiments are shown, for example, in FIGS. 6-10 as well as 15-19.

In case of a configuration that can be embodied in an especially simple and cost-effective manner, the locking fixing element may be configured as a shaped wire part. Related embodiments are shown, for example, in FIGS. 10-28.

If at least one and preferably each holding element is provided by a U-shaped end section of the locking fixing element, which said end section extends around the inner housing, a stable holding effect is achieved with an embodiment that can be embodied in a simple manner. FIG. 10 shows, for example, such an embodiment.

In an alternative embodiment, which is especially advantageous for a stable locking effect, the locking fixing element may be configured as a shaped sheet metal part. Related embodiments are shown, for example, in FIGS. 6-9 and 29-35.

A small number of components can be made possible here by at least one and preferably each holding element being provided by an end section of the locking fixing element, which said end section passes through an opening in the inner housing. FIGS. 6-9 show, for example, such an embodiment.

A stable, basically non-severable connection to the inner housing can be ensured by at least one and preferably each holding element being fixed at the inner housing by connection in substance. Such an embodiment is shown, for example, in FIG. 14.

The number of components can be further reduced by the locking fixing element being fixed at the inner housing in at least one and preferably each holding section by connection in substance. FIGS. 11-13 show, for example, such an embodiment.

In another alternative embodiment, which guarantees a very stable connection of a locking fixing element to the inner housing, at least one and preferably each holding element may be configured as a shaped sheet metal part. FIGS. 17-19 show, for example, such embodiments.

In a configuration that can be embodied in a simple manner with respect to the configuration of the locking fixing element, the holding area may comprise a holding section arranged at a circumferentially spaced location or/and at an axially spaced location from the locking meshing area. Such embodiments are shown, for example, in FIGS. 20-28.

A very stable connection to the inner housing can be achieved in this case as well by the holding section being fixed at the inner housing by connection in substance, or/and by the holding section passing through the inner housing. Provisions can be made in this case with a configuration that can be embodied in a simple manner for the locking fixing element to be configured as a shaped wire part and for the holding section to be made integrally in one piece with the locking fixing element. This is also shown, for example, in FIGS. 20-28.

In another alternative embodiment, in which a plurality of locking fixing elements arranged at circumferentially spaced locations from one another are used, the holding area may comprise in each of the locking fixing elements two holding sections, which are arranged at spaced locations from one another in the direction of the inner housing longitudinal axis and extend over the inner housing from an outer side radially inwards and extend behind the inner housing from an outer side and comprise a support section supported on the outer side between the holding sections, wherein at least one, radially outwards projecting locking meshing area is provided between the support section and one of the holding sections for meshing with an associated locking receiving area. FIGS. 29-35 show, for example, such a relative position of the two holding sections.

In order to guarantee a stable connection in this case to the inner housing, each holding section may comprise at least one holding leg extending over the inner housing in the area of a passage opening or in the area of an axial end of the inner housing from radially outwards to radially inwards and a holding projection projecting axially with respect to the holding leg and extending behind the inner housing on the inner side thereof.

In order to prevent one or more locking fixing elements from tilting laterally away in case of such an essentially axially oriented position of one or more locking fixing elements, it is proposed that the locking fixing element or each of these locking fixing elements be configured as a shaped sheet metal part. This is also shown, for example, in FIGS. 29-35.

In order to support the stable holding of the inner housing at the outer housing, mounting material arranged between the inner housing and the outer housing may be provided.

A defined positioning can be achieved in this case over the entire axial length of the inner housing, for example, by the locking fixing device acting in an axial end area of the inner housing between the inner housing and the outer housing and by the mounting material being provided at least in another axial end area of the inner housing between the inner housing and the outer housing.

The mounting material may be held under compression between the inner housing and the outer housing for a stable holding effect. Further, a stable and especially temperature-resistant holding effect can be guaranteed if the mounting material comprises wire material.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
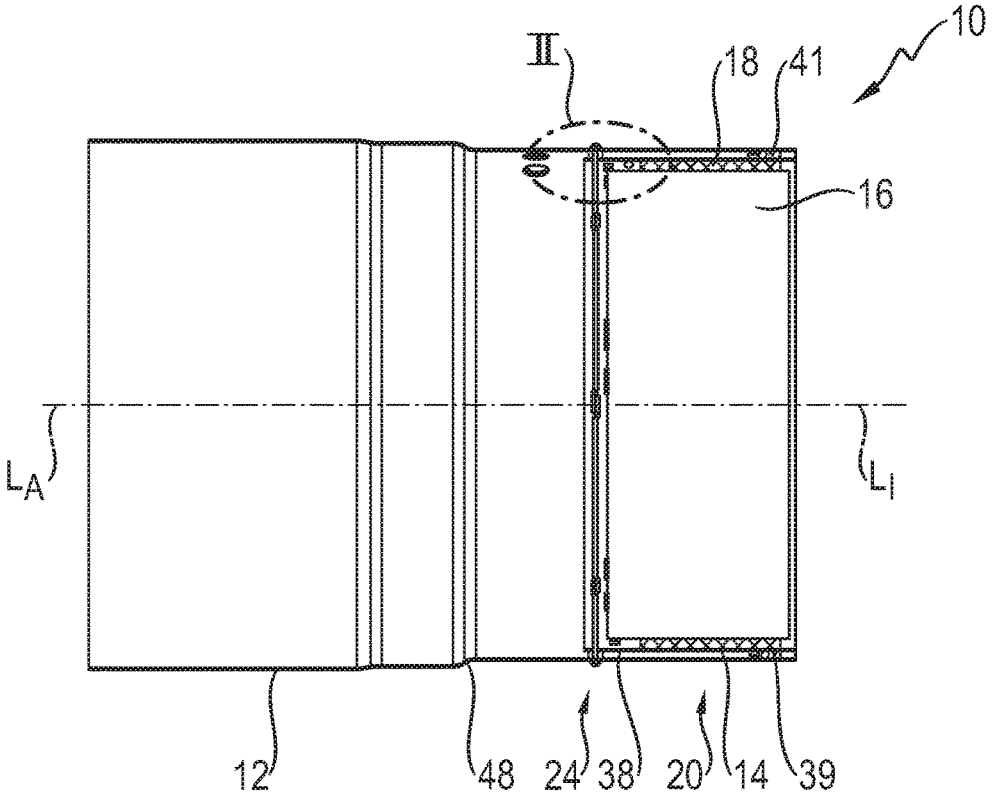
FIG. 1 is a sectional view of an exhaust gas treatment device.

Referring to the drawings, FIG. 1 shows in a longitudinal section an exhaust gas treatment assembly unit, generally designated by 10, for an exhaust system of an internal combustion engine in a vehicle. The exhaust gas treatment assembly unit 10 comprises a tubular outer housing 12, which is made, for example, of a sheet metal material and is elongated in the direction of an outer housing longitudinal axis $L_A$. The exhaust gas treatment assembly unit 10 further comprises a tubular inner housing 14, which is likewise provided, for example as a shaped sheet metal part and is elongated in the direction of an inner housing longitudinal axis $L_I$.

An exhaust gas treatment unit 16 is arranged and held in the inner housing 14. The exhaust gas treatment unit 16, configured, for example, as a catalytic converter, may comprise a monolith coated with catalytically active material and may be held in the inner housing 14 by a mounting mat 18 enclosing this exhaust gas treatment unit 16. The outer housing 12 may be closed by a deflecting housing in an axial end area 20 receiving the inner housing 14.

Figure 2:
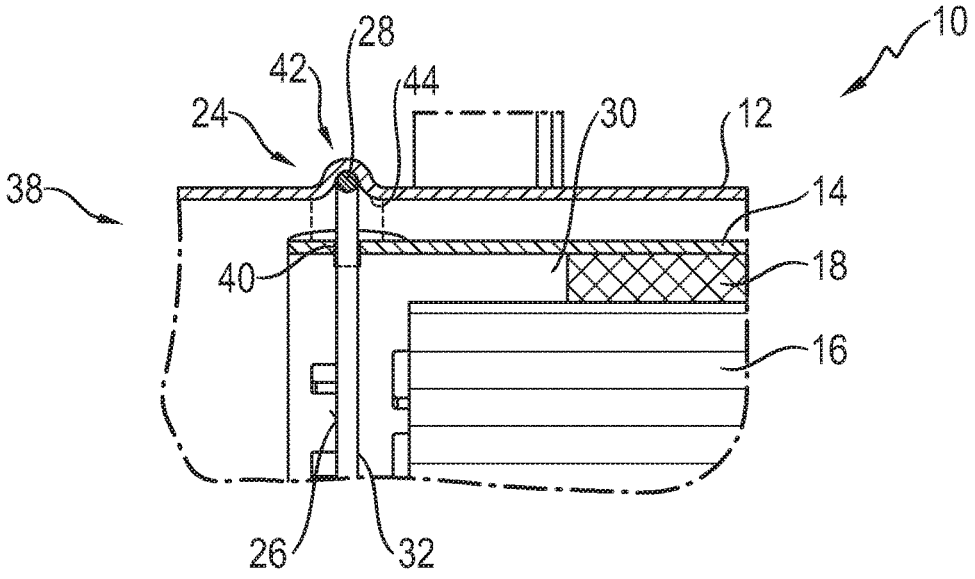
FIG. 2 is a detail view of area II in FIG. 1.
Figure 3:
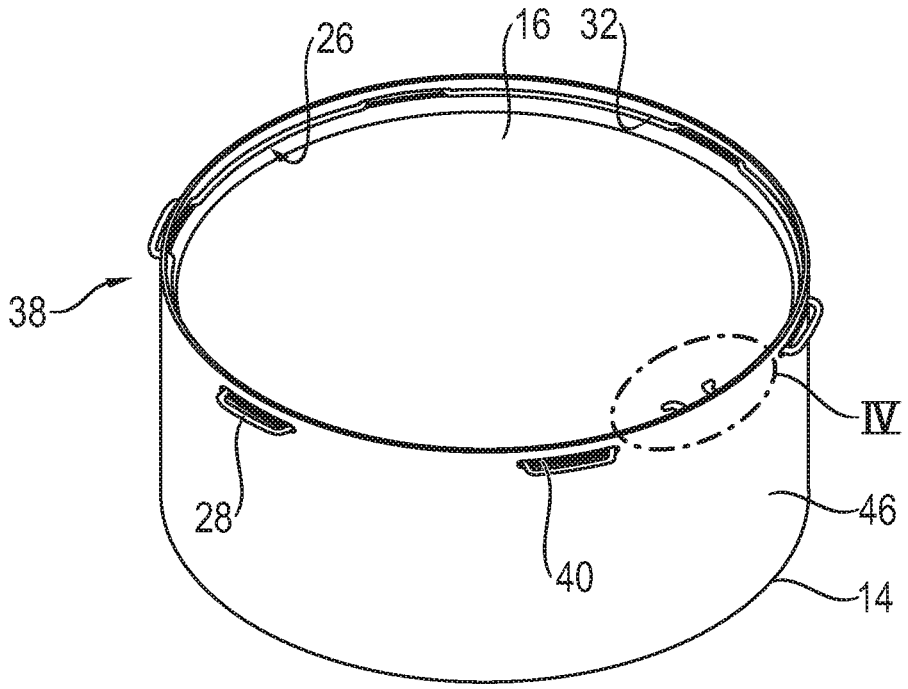
FIG. 3 is a perspective view of an inner housing with a ring-shape locking fixing element.
Figure 4:
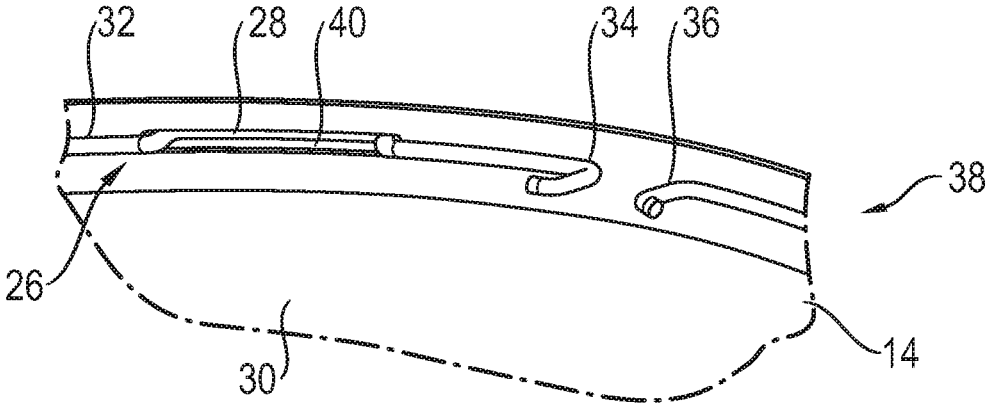
FIG. 4 is a detail view showing detail IV from FIG. 3 in an enlarged view.

FIG. 2 shows more clearly how the inner housing 14 is supported by means of a locking fixing device generally designated by 24 at the outer housing 12. The locking fixing device 24 comprises a locking fixing element 26, which has a ring-shape configuration in this exemplary embodiment. The locking fixing element 26 is provided as a shaped wire part and has a plurality of locking meshing areas 28 following one another in the circumferential direction about the inner housing longitudinal axis $L_I$. These locking meshing areas 28 provided with an essentially U-shaped form by bending a wire blank project radially outwards with respect to a ring body 32 of the locking fixing element 28. The ring body 32 is in contact with an inner side 30 of the inner housing 14 and extends about the inner housing longitudinal axis $L_I$ along the inner side 30 and is pressed, for example, by a prestress predefined by the shaping of the locking fixing element 26 against the inner side 30. As this is shown in FIGS. 3 and 4, the ring body 32 is open, i.e., it does not form a closed ring, so that this has two circumferential ends 34, 36, which are bent, for example, radially inwards, and which are located opposite each other with a small circumferential distance between two locking meshing areas 28. It should be noted that the two circumferential ends 34, 36 could also be connected to one another, for example, by welding, so that the ring body 32 may have basically a closed ring structure.

In association with each of the locking meshing areas 28, a passage opening 40, which is elongated in the circumferential direction at an axial end area 38 of the inner housing 14 and through which passes a respective locking meshing area 28, is provided at an axial end area 38 of the inner housing 14. The circumferential length of the passage openings 40 corresponds approximately to the circumferential length of the locking meshing areas 28, and an axial width of the passage openings 40 approximately corresponds to the thickness of the wire material of the locking fixing element 26, so that this is held in both axial directions and also in the circumferential direction in a defined manner at the inner housing 14.

In association with the locking fixing element 26 or its locking meshing areas 28, a locking receiving area designated by 42 is provided at the outer housing 12. The locking receiving area 42 may be provided by a bead-like (bead) bulge directed radially outwards and it thus forms a groove-like (groove) locking depression 44 passing through preferably without interruption in the circumferential direction.

When the inner housing 14 already containing the exhaust gas treatment unit 16 is pushed into the outer housing 12, for example, from the open side of the outer housing 12, which open side can be seen, for example, from the left-hand part of FIG. 1, the locking meshing areas 28, which are basically prestressed radially outwards and thus project radially over an outer side 46 of the inner housing 14, are displaced radially inwards during the movement over a bevel 48 that reduces the diameter of the outer housing 12. If the inner housing 14 is displaced farther in the direction of the end area 20 of the outer housing 12, the locking meshing areas 28 become aligned axially with the locking depression 44 and snap into this based on the inherent prestress of the locking fixing element 26. As a result, the inner housing 14 and hence also the exhaust gas treatment unit 16 being carried on this are held by the locking effect at the outer housing 12 in a stable manner and securely. Due to the force acting axially in the opposite direction, the locking meshing areas 28 are displaced radially inwards at the edge areas of the locking depression 44, so that the locking effect can be abolished and the inner housing 14 can be pushed again out of the outer housing 12 together with the exhaust gas treatment unit 16.

It should be noted that when, for example, the axial end area 20 of the outer housing 12 is not closed by a deflecting housing, the inner housing 14 can, of course, also be pushed into the outer housing 12 from this axial side.

Stable holding of the inner housing 14 in the outer housing 12 may further be supported by arranging mounting material 41, for example, wire material, for example, wire mesh or the like, between the inner housing 14 and the outer housing 12 at least in the other axial end area 39 of the inner housing 14. This mounting material 41 may be held under compression between the inner housing 14 and the outer housing 12, so that it supports the inner housing radially with respect to the outer housing 12 especially in the axial end area 39 of the inner housing 14 and it also transmits, moreover, a holding force acting in the axial direction between the inner housing 14 and the outer housing 12. The inner housing 14 is thus held in a stable manner in its two axial end areas 38, 39 both in the radial direction and in the axial direction with respect to the outer housing 12. The essential holding effect in the axial direction or/and in the radial direction can be provided here by the mounting material 41, while the locking fixing device 24 may have essentially the function of fixing and hence predefining a defined axial positioning of the inner housing 14 with respect to the outer housing 12.

Figure 1A:
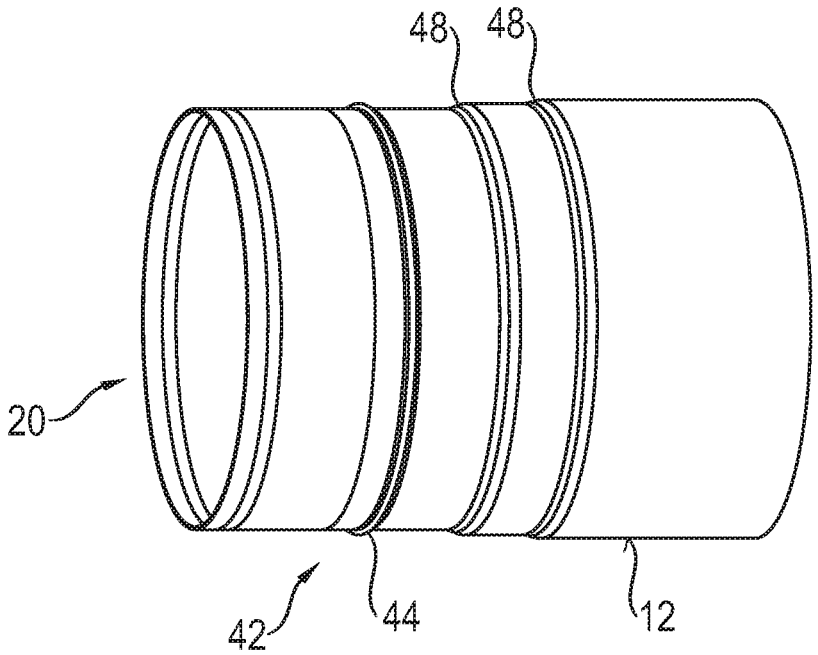
FIGS. 1*a*-1*d* are perspective views showing alternative configurations of an outer housing of an exhaust gas treatment assembly unit.

FIGS. 1*a*-1*d* show different embodiments of the outer housing 12. FIG. 1*a* shows the embodiment already described above with reference to FIGS. 1 and 2, in which the locking receiving area 42 has a locking depression 44 passing through without interruption in the circumferential direction.

Figure 1B:
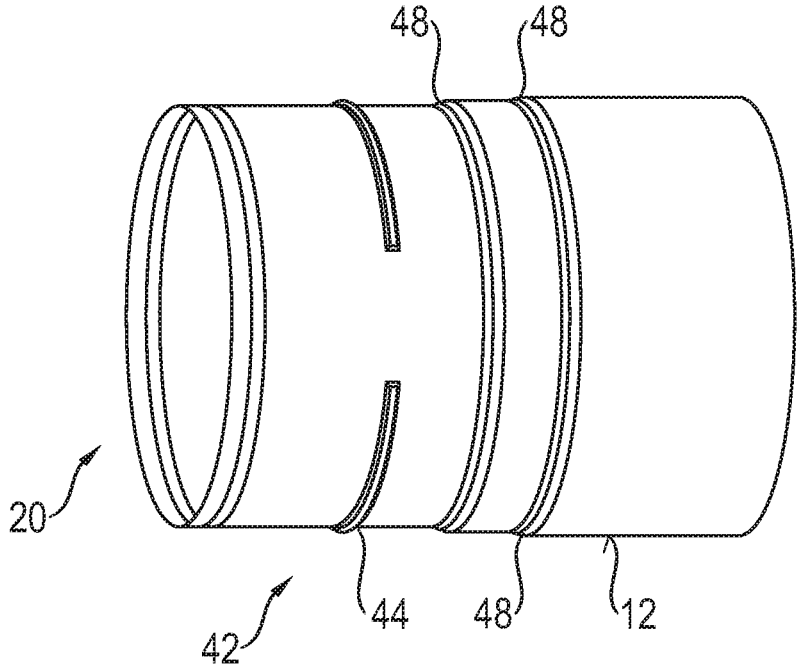

In the outer housing 12 shown in FIG. 1*b*, the locking receiving area 42 does not comprise a groove locking depression 44 passing through in the circumferential direction, but a locking depression 44, which is interrupted at least in a circumferential area, is open radially inwards and is formed by an outwardly formed bulge of the outer housing 12. It should be noted that a plurality of circumferential interruptions, for example, two circumferential interruptions, may also be provided, so that two longer areas of the locking depression 44, which areas extend in the circumferential direction, or a plurality of longer locking depressions 44 following one another in the circumferential direction may correspondingly be present.

Figure 1C:
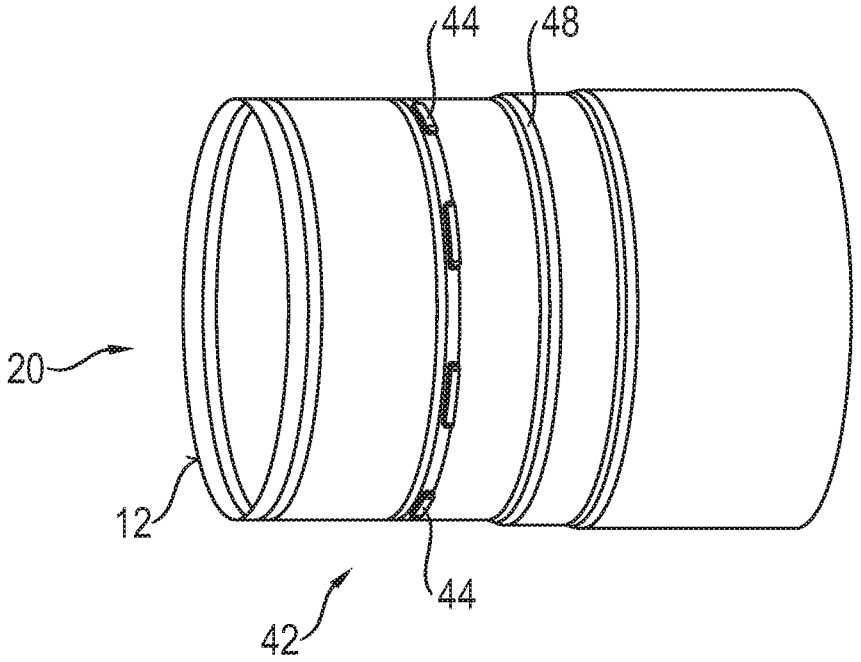

A plurality of locking depressions 44, which follow one another in the circumferential direction and are open radially inwards, are provided in the embodiment of the outer housing, which embodiment is shown in FIG. 1*c*. For example, such a locking depression 44, which is limited in the circumferential direction and corresponds, for example, in terms of its circumferential extension to the circumferential width of a respective locking meshing area 28, may be provided in association with each locking fixing element at the inner housing 14. A defined rotational positioning of the inner housing 14 with respect to the outer housing 12 may also be predefined in this manner by the locking effect of the locking fixing device 24. Each of the locking depressions 44 shown in FIG. 1*c* has essentially the same circumferential extension. Further, all the locking depressions 44 located directly adjacent to one another in the circumferential direction may have the same circumferential distance from one another.

Figure 1D:
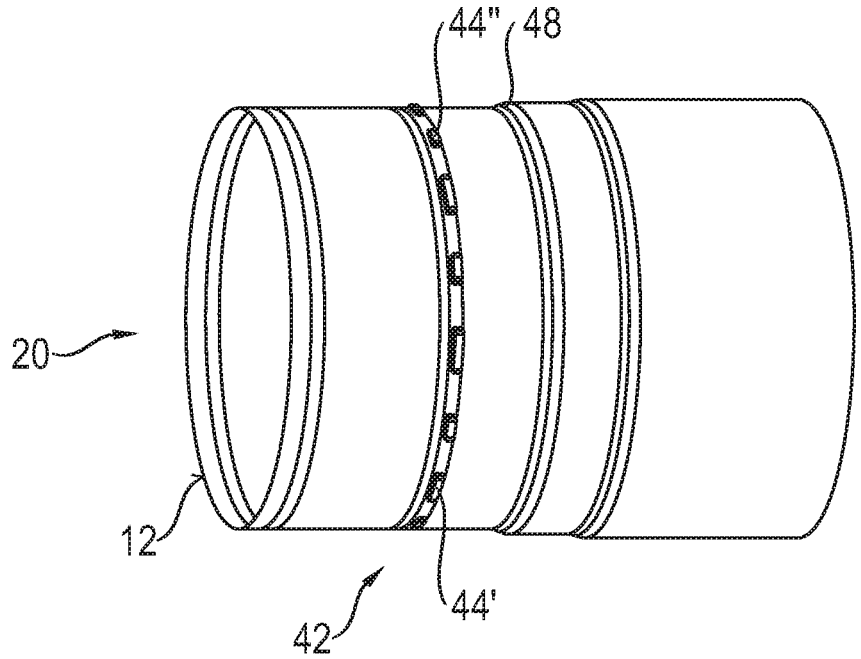

FIG. 1*d* shows an embodiment in which locking depressions 44' with a greater circumferential extension and locking depressions 44" with shorter circumferential extension are arranged in a mutually alternating manner. Corresponding to these locking depressions 44', 44" with different circumferential extensions, the locking meshing areas 28 of the locking fixing elements 26 provided at the inner housing 14 may have different circumferential extensions, so that a defined positioning of the inner housing 14 in the outer housing 12 is further supported.

Figure 5:
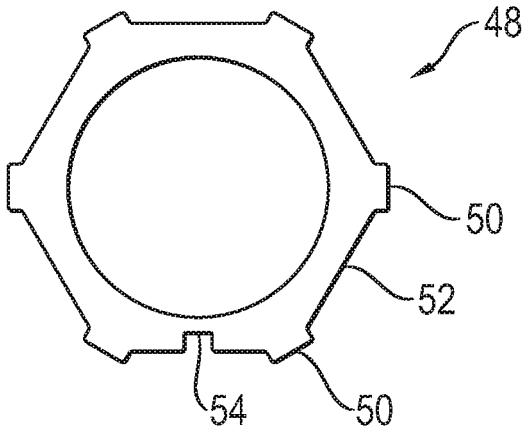
FIG. 5 is a top view of a tool for preparing a ring-shape locking fixing element.
Figure 6:
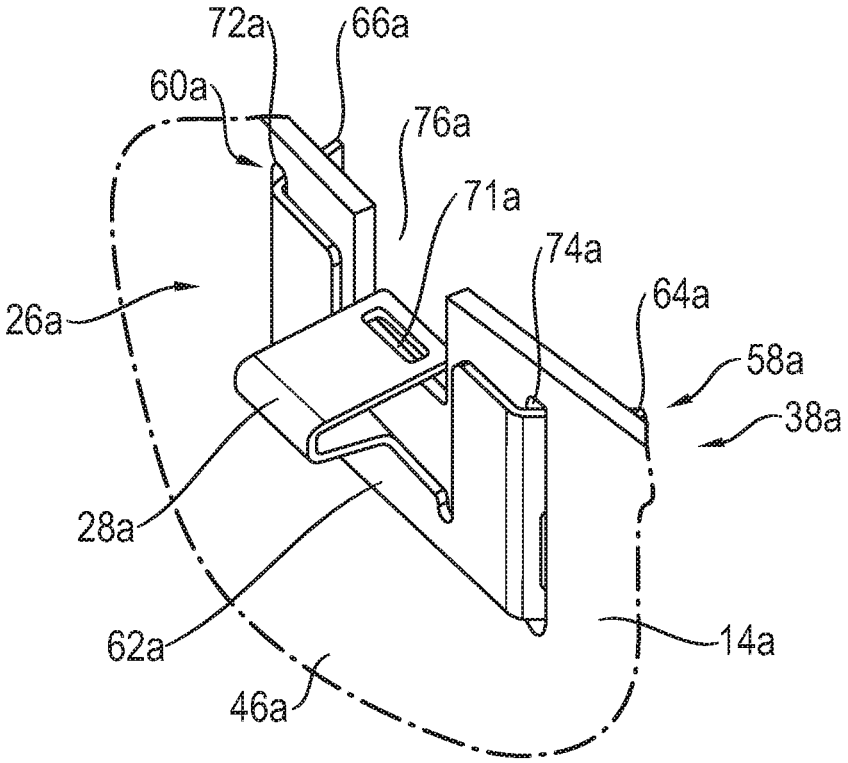
FIG. 6 is a perspective view of a locking fixing element, which is provided at an inner housing and is configured as a shaped sheet metal part.

FIG. 5 shows a tool 48, which can be used to bring a wire blank to the shape suitable for insertion into the inner housing 14. It is seen that in association with the locking meshing areas 28 to be provided at the locking fixing element 26, the tool 48 has radially outwards projecting projections 50 which predefine the shape of the locking meshing areas 28. In the exemplary embodiment of the tool 48 shown in FIG. 5, the edge areas 52 extending between two projections 50 have a configuration in which they extend essentially straight, so that the wire blank, which is to be wound around the outer circumference of the tool 50 and is to be adapted to the shape thereof, will also have between two locking meshing areas 28 to be formed thereon an essentially straight extension, which will consequently extend at a spaced location from the inner side 30 of the inner housing 14. Different shape specifications can, of course, be provided here for the tool 50 and hence also for the ring body 32 of the locking fixing element 26, which ring body 32 is to be embodied with it. In association with the circumferential ends 34, 36, which are to be shaped radially inwards, a recess 54 receiving these ends is provided on the tool 50.

Different alternative embodiments of an exhaust gas treatment assembly unit and of the locking fixing device fixing the inner housing at the outer housing will be described below with reference to FIGS. 6 through 19. Components that correspond to above-described components in terms of configuration and function are described with the same reference numbers with a suffix "a" added. It should be noted that the basic configuration of the outer housing 14*a* and of the inner housing 16*a* containing the exhaust gas treatment unit may be such as described above with reference to FIGS. 1 through 4.

In the embodiments of a locking fixing device 24*a*, which will be described below, this locking fixing device comprises a plurality of locking fixing elements 26*a*, which are arranged at spaced locations from one another in the circumferential direction about the inner housing longitudinal axis $L_I$, and are held or fixed at the inner housing 14*a*. All the locking fixing elements 26 to be fixed at the inner housing 14*a* have preferably but not necessarily an identical design in each of the embodiments described below.

A first embodiment of such locking fixing elements 26*a* is shown in FIGS. 6 through 9. Each locking fixing element 26*a* is configured as a shaped sheet metal part in this embodiment. The locking fixing element 26*a* has a holding area generally designated by 56*a*, with which this is held at the housing in the manner described below. Further, the locking fixing element 26*a* has a locking meshing area 28*a*, which is provided, for example, by correspondingly bending a sheet metal strap and which projects radially outwards with respect to the holding area 56*a*, and which can mesh with the locking depression at the outer housing, which said locking depression is described above with reference to FIG. 1, when the locking fixing element 26*a* is held at the inner housing 14*a*.

The holding area 56*a* has two holding sections 58*a*, 60*a*, which receive the locking meshing area 28*a* between them and enter into a holding interaction with the inner housing 14*a*. Each of these holding sections 58*a*, 60*a* is provided by a holding leg 64*a*, 66*a* bent radially inwards from a central area 62*a*, which also carries the locking meshing area 28*a*. A holding projection 68*a*, 70*a* bent in the direction away from the locking meshing area 28*a* is provided at each of the holding legs 64*a*, 66*a*.

In association with the two holding sections 58*a*, 60*a*, two passage openings 72*a*, 74*a* elongated essentially in the direction of the inner housing longitudinal axis $L_I$ are provided at the inner housing 14*a* at the axial end area thereof. One of the holding legs 64*a*, 66*a* passes through each of these passage openings 72*a*, 74*a* arranged at circumferentially spaced locations from one another, so that the central area 62*a* is in contact with the outer side 46*a* of the inner housing 14*a* and the holding projections 68*a*, 70*a* extend behind the inner housing 14*a* on the inner side 30*a* thereof.

Figure 9:
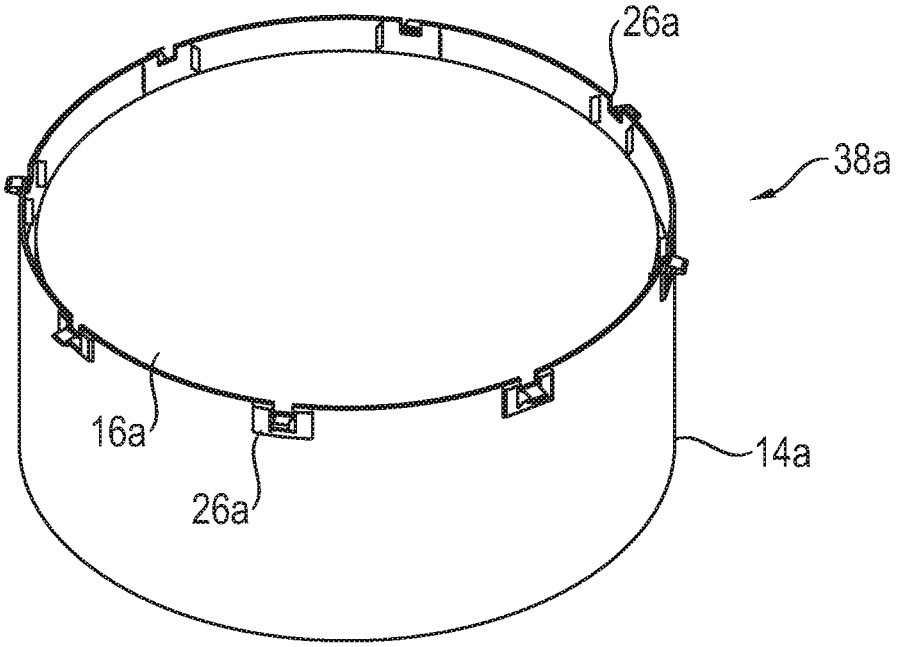
FIG. 9 is a perspective view of an inner housing with a locking fixing element according to FIGS. 6 through 8, which is provided thereon.

Each of the locking fixing elements 26*a*, which can be seen in FIG. 9 and is arranged at circumferentially spaced locations from one another at the axial end area 38*a* of the inner housing 14*a*, is thus held in a stable manner at the inner housing 14*a* by the two holding sections 58*a*, 60*a*, which are arranged at circumferentially spaced locations from one another and receive the locking meshing area 28*a* between them, in such a manner that based on the shape of the respective locking meshing area 28*a*, this area can deflect radially when the inner housing 14*a* carrying the locking fixing elements 26*a* is pushed into the outer housing. Based on their inherent prestress, the locking meshing areas 28*a* deflect into the radially inwardly open locking depression at the outer housing and thus fix the inner housing 14*a* by a locking effect. In order to make this radial movement of the locking meshing areas 28*a* possible, an axially open recess 76*a*, into which the locking meshing area 28*a* provided with a U-shaped form can deflect with the free U-leg thereof, can be provided at the axial end area 38*a* of the inner housing 14*a* in association with each of the locking fixing elements 26*a*.

To sever the locking meshing of the locking meshing area 28*a* of the locking fixing element 26*a* or of each locking meshing element 26*a*, a tool, for example, a screwdriver or the like, can be used to mesh with a tool insertion opening 71*a* provided at the free U-leg of the locking meshing area 28*a* having a U-shaped configuration. Even though this tool insertion opening 71*a* is positioned radially in the area of the wall of the inner housing 14*a*, this access is possible via the axially open recess 76*a*. By pulling radially inwards, the locking meshing area 28*a* or each locking meshing area 28*a* can be pulled out of the locking receiving area, which received this before.

Figure 10:
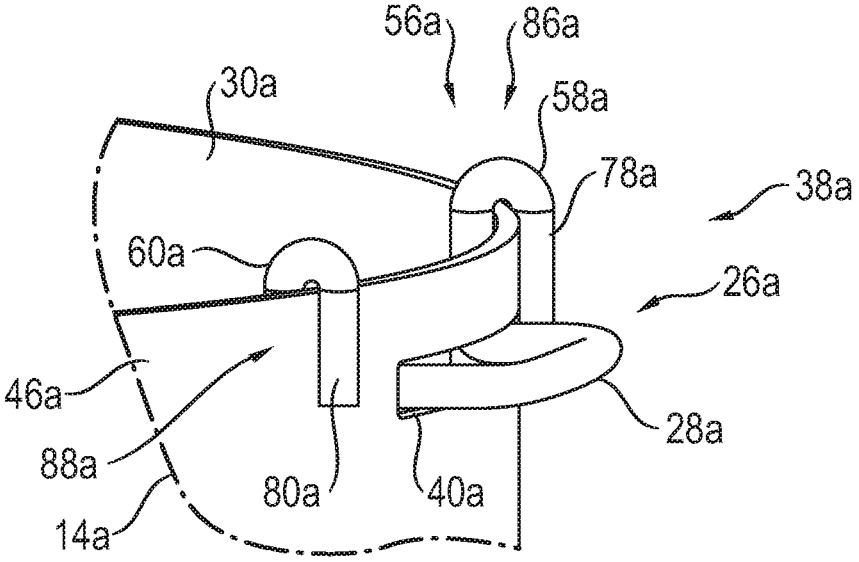
FIG. 10 is a cut away view showing a locking fixing element, which is provided as a shaped wire part, at an inner housing of an exhaust gas treatment assembly unit.

FIG. 10 shows a locking fixing element 26*a* provided as a shaped wire part. This has a U-shaped locking meshing area 28*a* passing through a corresponding passage opening 40*a* in the axial end area 38*a* of the inner housing 14*a*. The locking meshing area is adjoined in the circumferential direction on both sides of the locking meshing area 28*a* by the holding sections 58*a*, 60*a* of the holding area 56*a*. Each of the holding sections 58*a*, 60*a* comprises an end section 78*a*, 80*a* of the locking fixing element 26*a*, which said end section is bent in the shape of a U and which extends around the inner housing 14*a* at its axial end area 38*a* from radially inwards to radially outwards.

It should be noted that, of course, a plurality of locking fixing elements 26*a* arranged following one another in the circumferential direction are also provided at the inner housing 14*a* in such a configuration of the locking fixing element 26*a*. It can especially be seen that the passage openings 40*a* provided at the inner housing 14 can be used in this connection, which passage openings may also be used, for example, for receiving the ring-shape locking fixing element 26 that can be seen in FIG. 3. Depending, for example, on the intended use, the inner housing 14 or 14*a* configured with respective passage openings 40 and 40*a* elongated in the circumferential direction may be equipped either with the ring-shape locking fixing element 26 that can be seen in FIG. 3 and FIG. 4 or with a plurality of the locking fixing elements 26*a* shown in FIG. 10.

Figure 11:
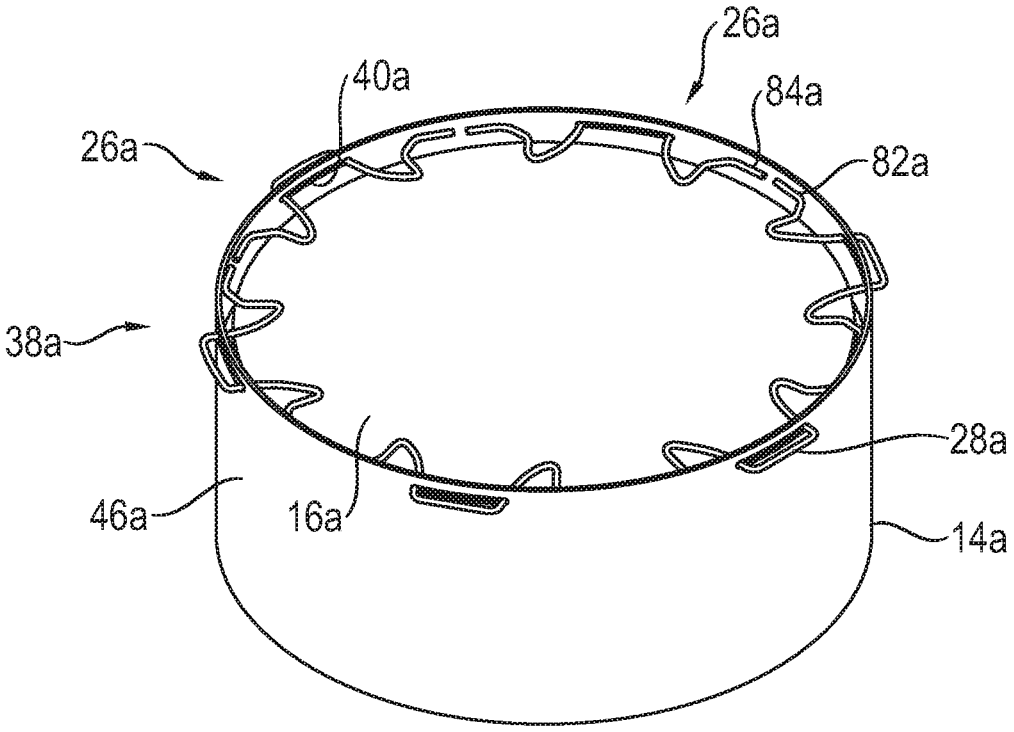
FIG. 11 is a perspective view of an inner housing of an exhaust gas treatment assembly unit with a plurality of locking fixing elements provided as shaped wire parts.
Figure 12:
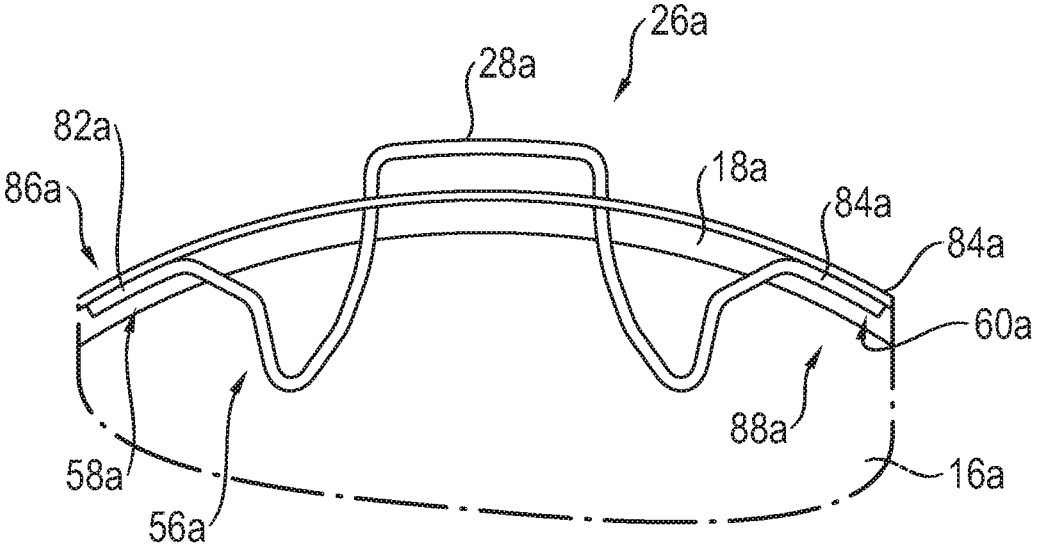
FIG. 12 is a cut away view showing a locking fixing element according to FIG. 11 at the inner housing.
Figure 13:
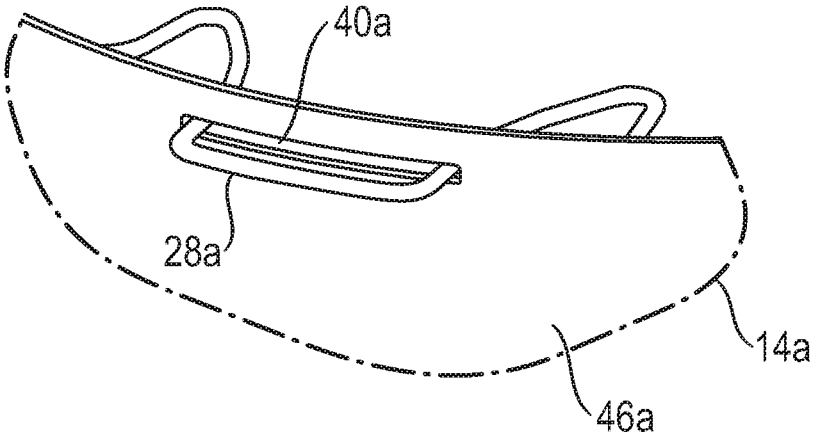
FIG. 13 is a cut away view showing the inner housing from an outer side with a locking fixing element according to FIGS. 11 and 12.

Another embodiment of a locking fixing device 24*a*, which can use such passage openings 40*a* elongated in the circumferential direction at the axial end area 38*a* of the inner housing 14*a*, is shown in FIGS. 11 through 13. Each of the plurality of locking fixing elements 26*a* arranged following one another in the circumferential direction is provided in this embodiment again as a shaped wire part. The locking meshing area 28*a*, which has a U-shaped configuration and with which each locking fixing element 26*a* passes through the associated passage opening 40*a* from radially inwards to radially outwards, is provided in an area that is a central area in the circumferential direction, so that the locking meshing area 28*a* projects radially on the outer side 46*a* of the inner housing 14*a*.

The two holding sections 58*a*, 60*a* of the holding area 56*a* are provided on both sides of the locking meshing area 28*a* by respective circumferential ends 82*a*, 84*a* of the locking fixing element 26*a*. The locking fixing element 26*a* is fixed in each of these circumferential ends 82*a*, 84*a* by connection in substance, for example, by welding on the inner side 30*a* of the inner housing 14*a*.

FIG. 11 shows that a ring-shape structure, in which the respective circumferential ends 82*a*, 84*a* of adjacent locking fixing elements 26*a* are located opposite each other in the circumferential direction between two locking meshing areas 28*a* following one another in the circumferential direction or between passage openings 40*a* receiving these, is basically obtained with the plurality of locking fixing elements 26*a* following one another in the circumferential direction. Such a structure could also be provided, for example, with a single locking fixing element, as this was described above with reference to FIGS. 1 through 4.

In the embodiments described above with reference to FIGS. 6-13, the locking fixing elements 26*a* in the respective holding sections 58*a*, 60*a* have holding elements 86*a* and 88*a*, respectively, which are configured integrally at the locking fixing elements 26*a*. These are provided in the exemplary embodiment according to FIGS. 6-9 essentially by the holding legs 64*a*, 66*a*. The U-shaped end sections 78*a*, 80*a* provided in the holding sections 58*a*, 60*a* provide the holding elements 86*a*, 88*a* configured integrally with the locking fixing element 26*a* in the exemplary embodiment according to FIG. 10. In the exemplary embodiment according to FIGS. 11-13, the circumferential ends 82*a*, 84*a* provide these holding elements 86*a*, 88*a* configured integrally with the locking fixing element 26*a*.

Embodiments in which the holding elements 88*a* are provided as separately configured components on a respective locking fixing element 26*a* will be described below.

Figure 14:
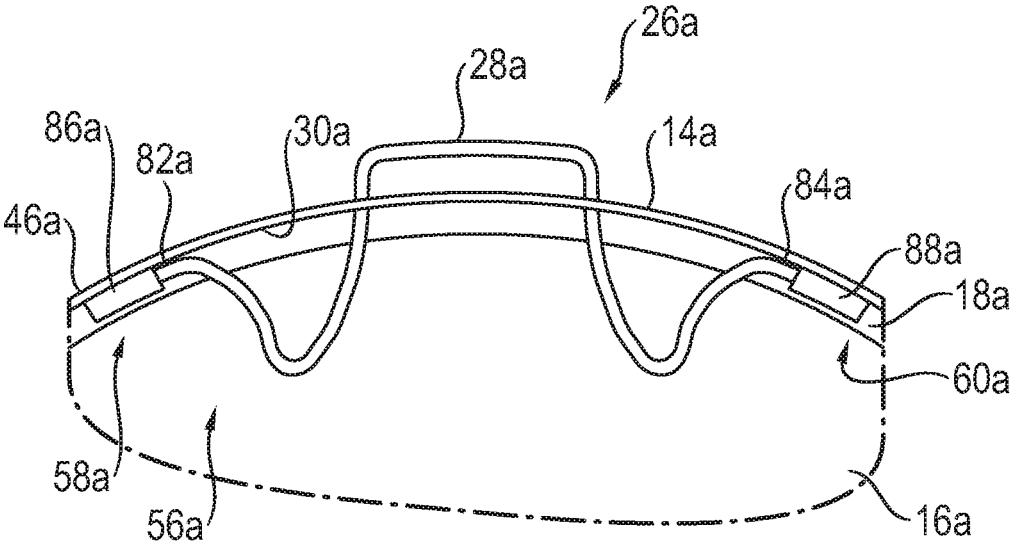
FIG. 14 is a cut away view showing, corresponding to the view of FIG. 12, an alternative type of connection of a locking fixing element to the inner housing.

A variant of the embodiment described above with reference to FIGS. 11 through 13 is shown in FIG. 14. The locking fixing element 26*a* or each locking fixing element 26*a* is not fixed directly with its circumferential ends 82*a*, 84*a* at the inner housing 14*a* in this embodiment. Rather, sleeve-like (sleeve) holding elements 86*a*, 88*a*, into which a respective circumferential end 82*a*, 84*a* is inserted, are provided, for example, in association with each of the circumferential ends 82*a*, 84*a* or with each holding section 58*a*, 60*a*. The holding elements 86*a*, 88*a* may be fixed by connection in substance, for example, by welding, on the inner side 30*a* of the inner housing 14*a*. It is possible now to proceed, for example, such that the sleeve holding elements 86*a*, 88*a* are fixed at first at the inner housing 14*a* in the circumferential direction on both sides of a respective passage opening 40*a* and the locking meshing element 26*a*, which is basically elastically deformable due to being made of a wire material, is passed with its locking meshing area 28*a* through the associated passage opening 40*a* and the two circumferential ends 82*a*, 84*a* are inserted in the circumferential direction into openings formed in the holding elements 86*a*, 88*a* and are held therein by circumferential prestress. As an alternative, the circumferential ends 82*a*, 84*a* may be received at first in the holding elements 86*a*, 88*a*, for example, by means of press fit. The locking fixing element 26*a* equipped with the holding elements 86*a*, 88*a* can then be brought closer to the inner housing 14*a* from the radially inner direction, and, after the locking meshing area 28*a* had been passed through the associated passage opening 40*a*, the two holding elements 86*a*, 88*a* can be fixed on the inner side 30*a* of the inner housing 14*a*.

Figure 15:
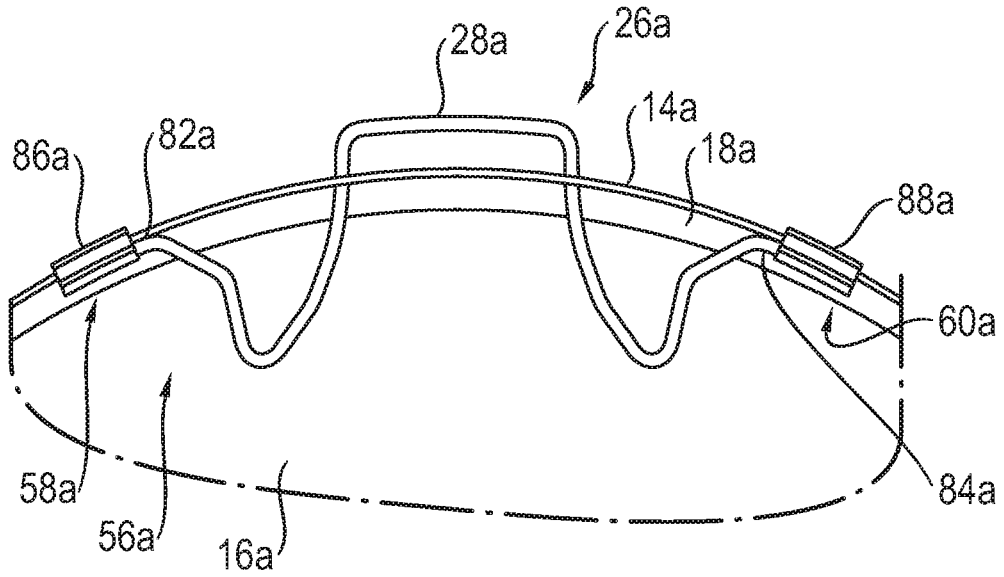
FIG. 15 is a view corresponding to FIG. 14 with another alternative type of connection of a locking fixing element to the inner housing.
Figure 16:
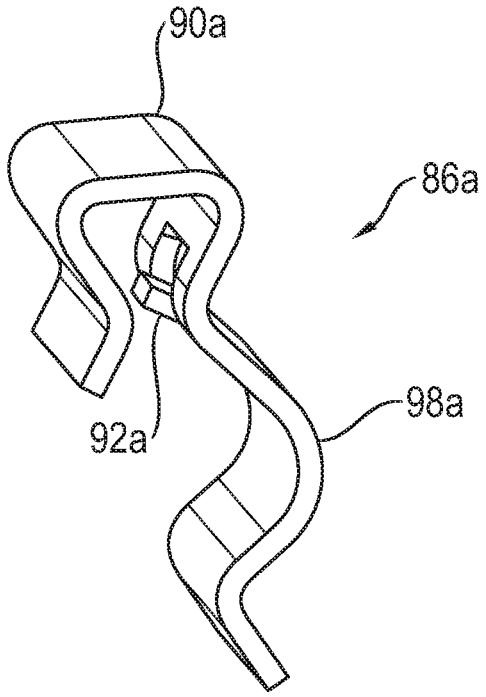
FIG. 16 is a perspective view showing a holding element used in the embodiment according to FIG. 15 for connecting a locking element to the inner housing.
Figure 17:
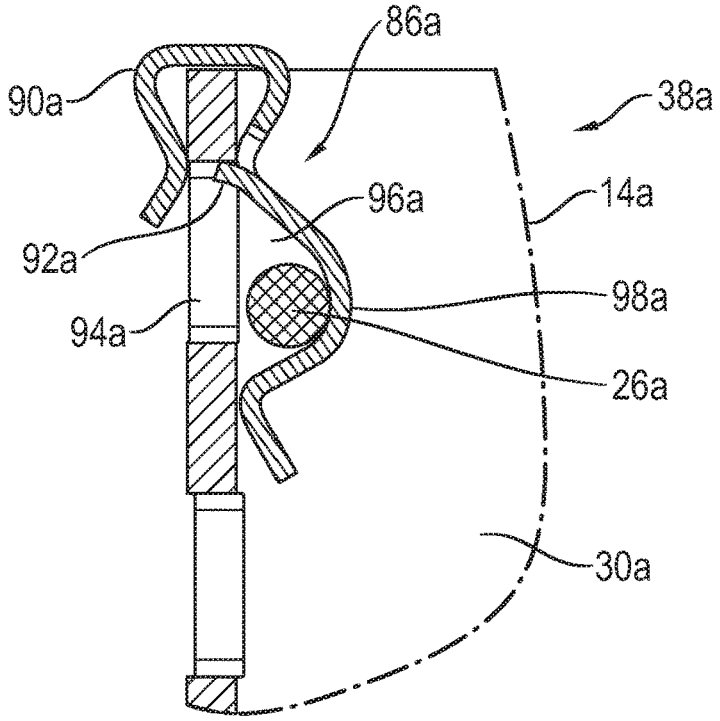
FIG. 17 is a partial longitudinal sectional view of the inner housing with a locking fixing element held at the inner housing by a holding element according to FIG. 16.

FIGS. 15 through 17 show another embodiment, in which a locking fixing element 26*a* provided as a shaped wire part is fixed in the two holding sections 58*a*, 60*a* of the holding area 56*a* by the use of two holding elements 86*a*, 88*a* at the inner housing 14*a*. Each of these holding elements 86*a*, 88*a* is provided as a shaped sheet metal part, as is shown especially in FIG. 16 on the basis of the holding element 86*a*. The holding element 86*a* has an approximately U-shaped fixing area 90*a*, which extends over the inner housing 14*a* in the axial end area 38*a* thereof and with which the holding element 86*a* is pushed axially over the inner housing 14*a*. In association with the U-shaped fixing area 90*a*, a fixing projection 92*a* is provided, which projects into this fixing area 90*a* and which enters an associated fixing recess 94*a* formed in the inner housing 14*a* when the holding element 86*a* is pushed axially on and thus ensures a stable fixing of the holding element 86*a* at the axial end area 38*a* of the inner housing 14*a*.

Figure 7:
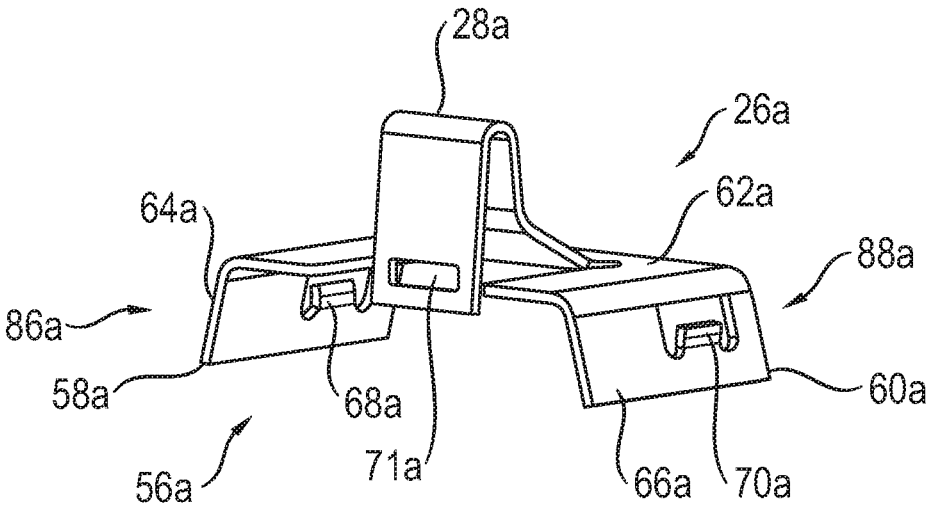
FIG. 7 is a perspective view showing the locking fixing element shown in FIG. 6.
Figure 8:
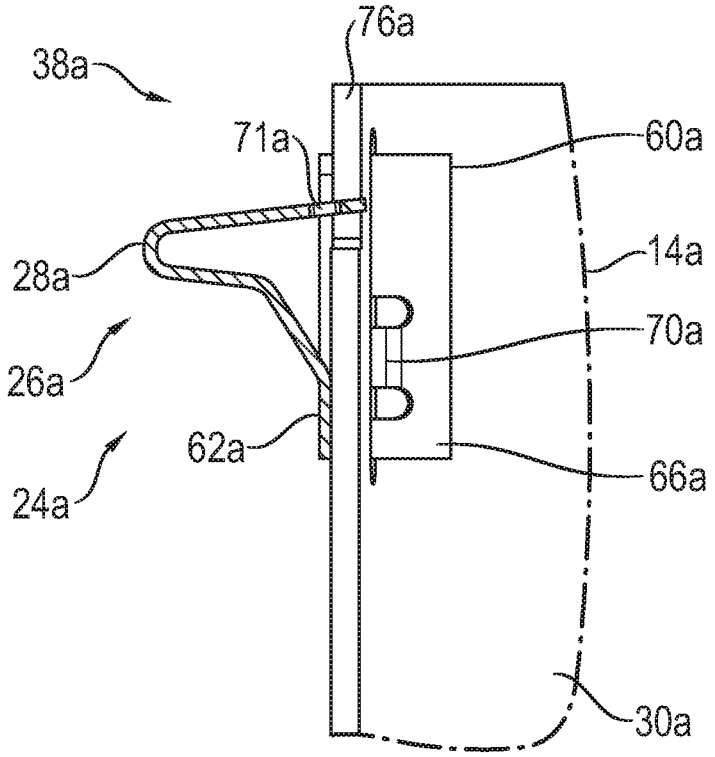
FIG. 8 is a longitudinal sectional view of an inner housing with the locking fixing element according to FIGS. 6 and 7, which is carried thereon.

Starting from the approximately U-shaped or Ω-shaped fixing area 90*a*, the holding element 86*a* has an arc-shaped receiving area 98*a*. As this is illustrated in FIG. 7, the arc-shaped receiving area 98*a* forms, together with the inner housing 14*a*, a receiving opening 96*a*, into which the circumferential end 82*a* of the locking fixing element 26*a* can be pushed in the circumferential direction. FIG. 17 illustrates in this connection by the mutually intersecting contours of the receiving area 98*a* and of the circumferential end 82*a* that the receiving area 98*a* is shaped basically such that the radial width of the receiving opening 96*a* is smaller than the thickness of the wire material of the locking fixing element 26*a*, so that the locking fixing element 26*a* is pressed with its circumferential end 82 by the arc-shaped receiving area 98*a* against the inner side 30*a* of the inner housing 14*a*.

Figure 18:
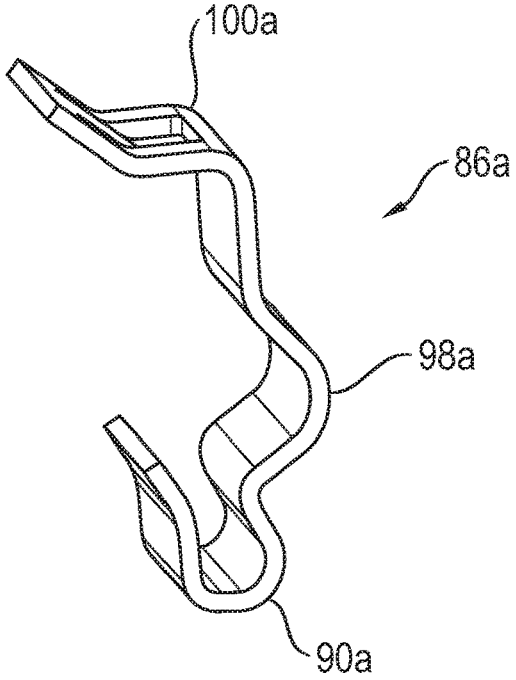
FIG. 18 is a perspective view showing an alternative embodiment of a holding element.
Figure 19:
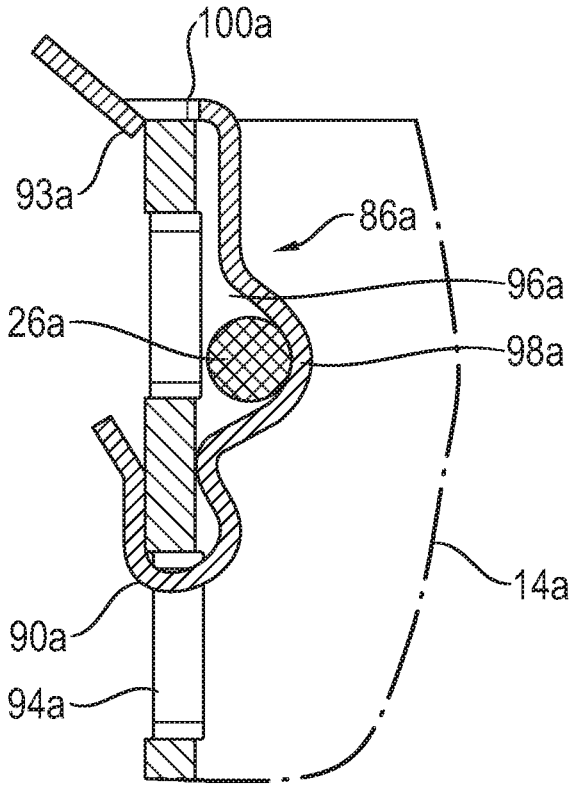
FIG. 19 is a partial longitudinal sectional view of the inner housing with a locking fixing element held at the inner housing by a holding element according to FIG. 18.

An alternative embodiment of a holding element 86*a* provided as a shaped sheet metal part is shown in FIGS. 18 and 19. The holding element 86*a* has again a U-shaped or Ω-shaped fixing area 90*a*, which is not pushed over an axial end of the inner housing 14*a* in this embodiment, but is positioned such that it meshes with a fixing recess 94*a* provided at a spaced location from the axial end of the inner housing 14*a*, so that the holding element 86*a* passes basically through the inner housing 14*a* in the area of the fixing recess 94*a* from radially inwards and extends over and behind it on its outer side 46*a*. The fixing area 90*a* is adjoined again by the arc-shaped receiving area 98*a*. This arc-shaped receiving area 98*a* is joined by another fixing section 100*a* extending over the axial end of the inner housing 14*a* radially outwards. A fixing projection 93*a* extending over the inner housing 14*a* on its outer side 46*a* is formed at this fixing section 100*a*, so that the holding element 86*a* passes through and extends over the inner housing 14*a* in this embodiment in two axial areas, axially on both sides of the receiving area 98*a* from radially inwards to radially outwards, and it extends behind it on its outer side. As a result, very stable holding is guaranteed at the inner housing 14*a*.

With reference to FIGS. 20 through 28, the following embodiments of the locking fixing device will be described, in which a plurality of locking fixing elements following one another in the circumferential direction are used again, but these are not fixed on both sides of a respective locking meshing area at the inner housing. Rather, each locking fixing element is shaped in the embodiments described with reference to FIGS. 20 through 28 such that the holding area comprises only a single holding section, which is arranged either on a circumferential side or on an axial side with respect to the respective locking meshing area provided at this locking fixing element. Components that correspond in terms of configuration and function to components and embodiments described above are designated by the same reference numbers to which the suffix "b" is added.

Figure 20:
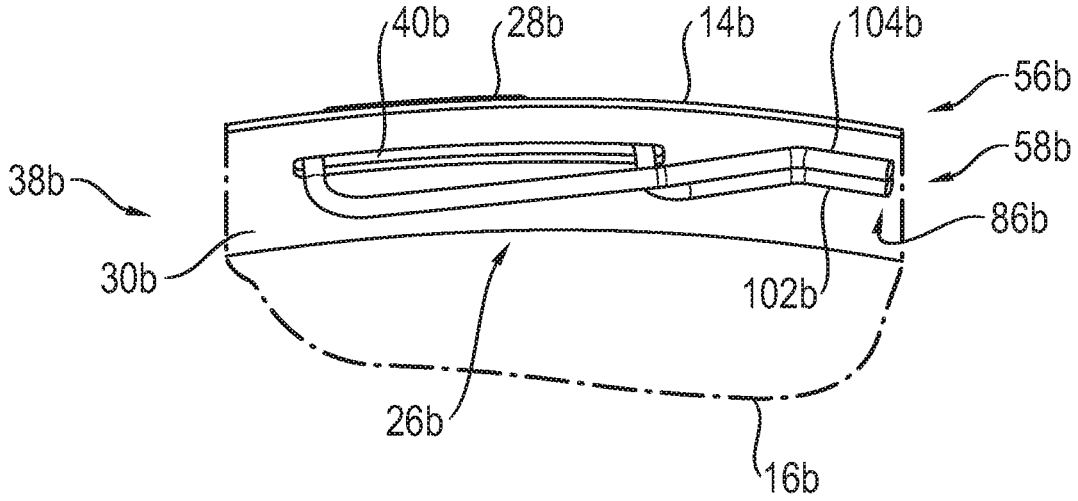
FIG. 20 is a cut away view showing an alternative embodiment of a locking fixing element configured as a shaped wire part.
Figure 21:
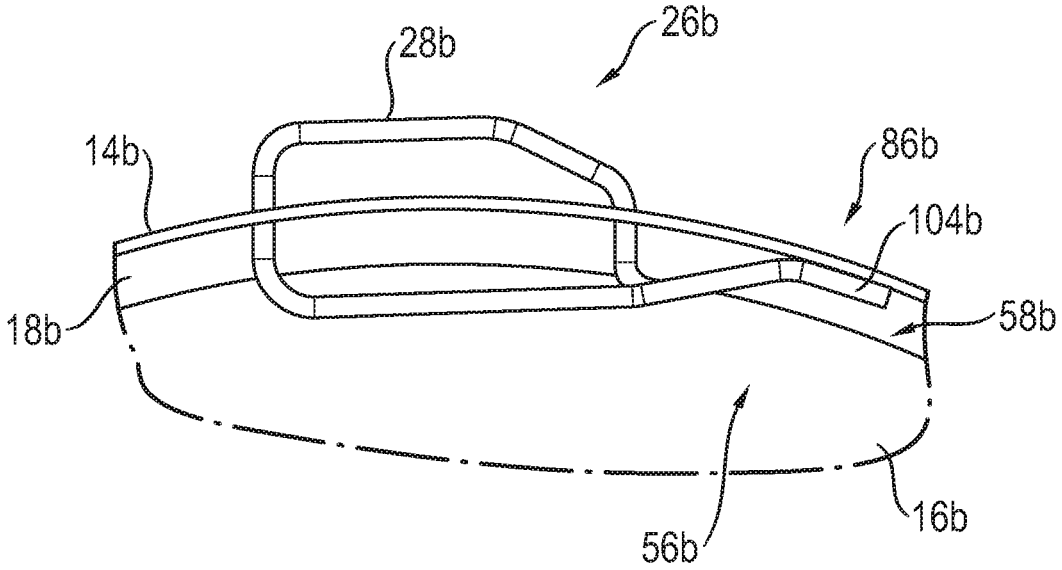
FIG. 21 is an axial cut away view showing a locking fixing element according to FIG. 20, which is arranged at the inner housing.

FIGS. 20 and 21 show a locking fixing element 26*b*, which is provided as a shaped wire part and which is positioned again with its locking meshing area 28*b* having an essentially U-shaped configuration such that it passes again through a passage opening 40*b* provided in the axial end area 38*b* of the inner housing 14*b* from radially inwards to radially outwards. The locking fixing element 26*b* provided as a shaped wire part is shaped such that the end legs 102*b*, 104*b* thereof are positioned such that they are located, for example, adjacent to one another in the axial direction on a circumferential side with respect to the locking meshing area 28*b*. The locking fixing element 26*b* can be fixed with these two end legs 102*b*, 104*b* on the inner side 30*b* of the inner housing 14*b* by connection in substance, for example, by welding. Based on the elasticity of the wire material, of which the locking fixing element 26*b* is made, this can deflect radially inwards with its locking meshing area 28*b* when the inner housing 14*b* equipped with a plurality of such locking fixing elements 26*b* is pushed into the outer housing. These locking meshing areas 28*b* can then also snap again into the locking depression provided on the outer housing and thus ensure fixing of the inner housing 14*b* on the outer housing.

In this embodiment, the holding area 56*b* forms with the two end legs 102*b*, 104*b* providing the holding section 58*b* thereof a holding element 86*b* configured integrally with the locking fixing element 26*b*, with which, extending beyond the locking meshing area 28*b*, which passes through the passage opening 40*b* and is thus held in both axial directions, the locking fixing element 26*b* is fixed at the inner housing 14*b* in both axial directions by connection in substance.

Figure 22:
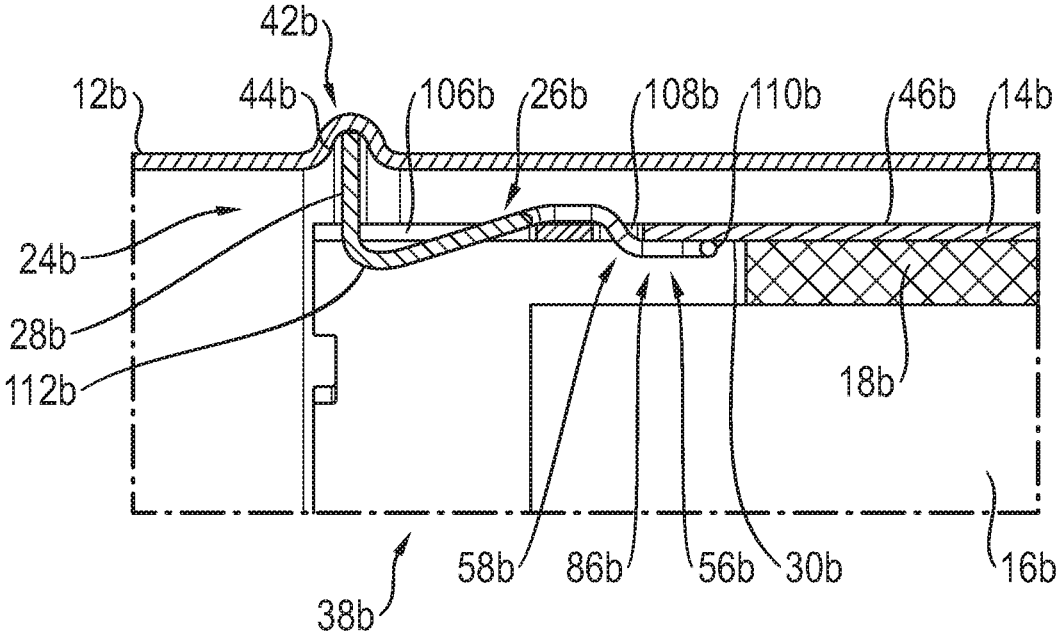
FIG. 22 is a partial sectional view showing an inner housing held at an outer housing of an exhaust gas treatment assembly unit by an alternative configuration of locking fixing elements provided as a shaped wire part.
Figure 23:
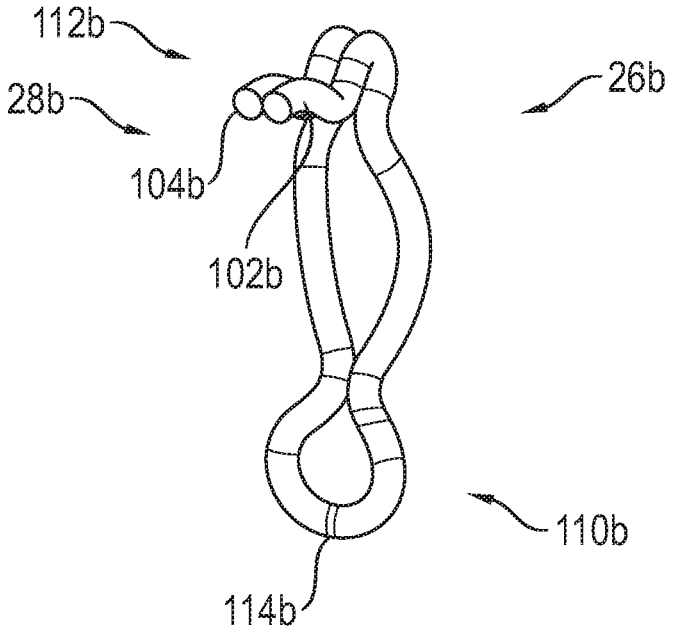
FIG. 23 is a perspective view showing a locking fixing element that can be used in the embodiment according to FIG. 22.
Figure 24:
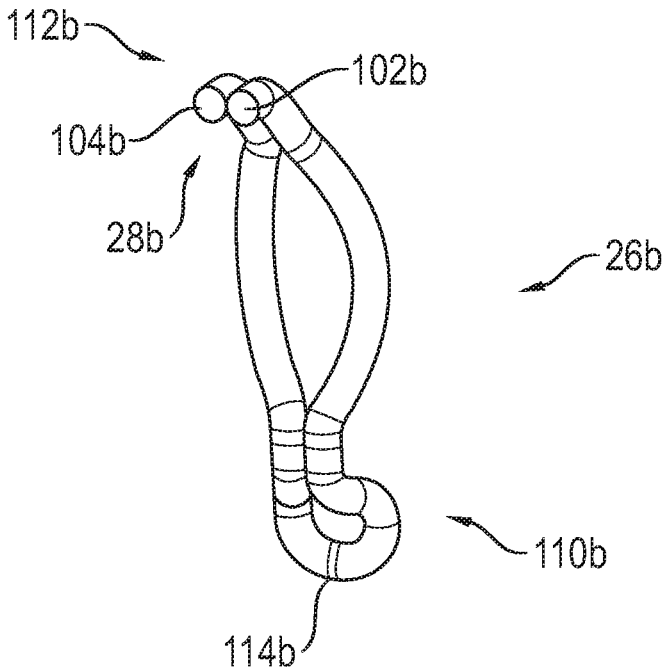
FIG. 24 is a perspective view showing another locking fixing element that can be used in the embodiment according to FIG. 22.
Figure 25:
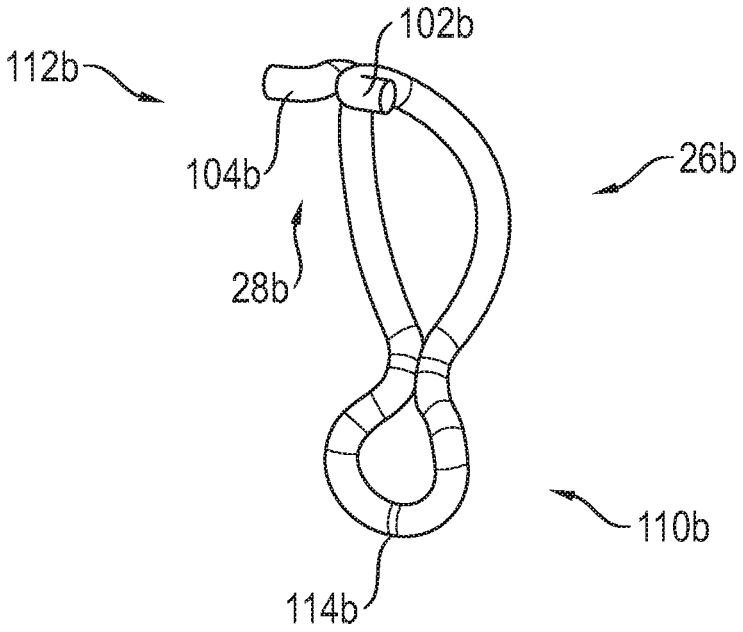
FIG. 25 is a perspective view showing another locking fixing element that can be used in the embodiment according to FIG. 22
Figure 26:
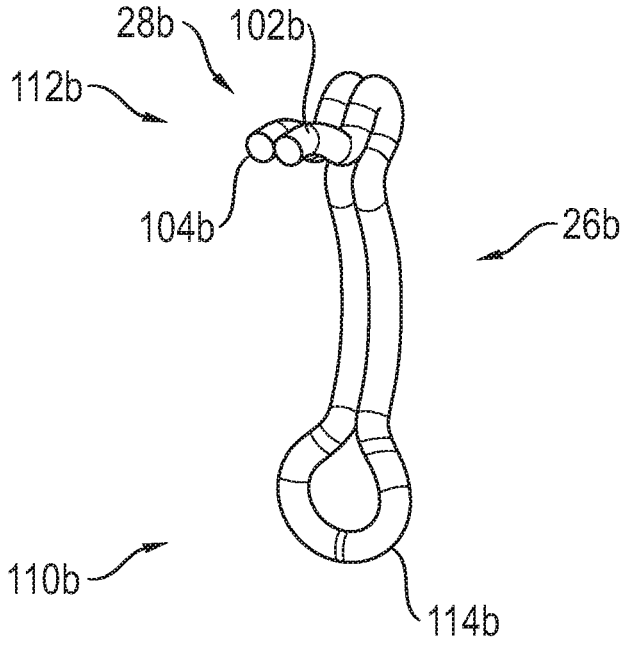
FIG. 26 is a perspective view showing another locking fixing element that can be used in the embodiment according to FIG. 22.
Figure 27:
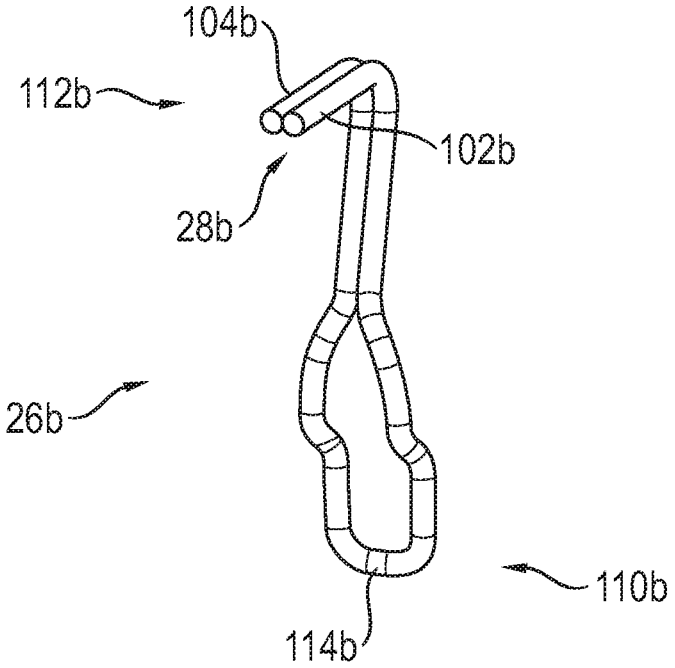
FIG. 27 is a perspective view showing another locking fixing element that can be used in the embodiment according to FIG. 22.

An alternative embodiment to this is shown in FIG. 22. The inner housing 14*b* positioned in the outer housing 12*b* with the exhaust gas treatment unit 16*b* carried therein is seen. A recess 106*b*, which is, for example, open axially, is provided in the axial end area 38*b* of the inner housing 14*b* for the locking fixing element 26*b*, which is provided again as a shaped wire part. With a holding section 58*b* of the holding area 56*b*, which said holding section is bent in an approximately S-shaped form, the locking fixing element 26*b* passes through an additional recess 108*b* provided in the inner housing 14*b* from radially outwards to radially inwards and is supported with an axial end area 110*b* thereof on the inner side 30*b* of the inner housing 14*b*. For example, the locking fixing element 26*b* can be fixed with its axial end area 110*b* on the inner side 30*b* of the inner housing 14*b* by connection in substance, for example, by welding. In this case as well, the holding area 56*b* with the bent holding section 58*b* passing through the inner housing 14*b* forms a holding element 86*b* made integrally in one piece with the locking fixing element 28*b*, with which the locking fixing element 26*b* is fixed at the inner housing 14*b* in both axial directions.

In its other axial end area 112*b*, the locking fixing element 26*b* forms the radially outwards projecting locking meshing area 28*b*, which fixes the inner housing 14*b* at the outer housing 12*b* by meshing with the locking depression 44*b* on the outer housing 12*b*, prestressed radially outwards.

FIGS. 23 through 28 show different embodiments for such locking fixing elements provided as shaped wire parts. All these locking fixing elements 26*b* are shaped such that the end legs 102*b*, 104*b* of the locking fixing element 26*b* are located next to one another in the end area 112*b*, in which the locking meshing area 28*b* is also formed, and they are firmly connected to one another, for example, by connection in substance. The locking fixing element 26*b* forms in the end area 110*b* an arc 114*b*, which can be supported on the inner side 30*b* of the inner housing 14*b*.

FIGS. 23 through 28 show that in the same configuration, the shape of the locking fixing element 26*b* or of each locking fixing element 26*b* may be different both in the end area 110*b* and in the end area 112*b* as well as in the length area connecting these two end areas. Thus, as is shown, for example, in FIG. 25, the two end legs 102*b*, 104*b* may be shaped such that their free ends are bent away from one another in the circumferential direction, so that, unlike, for example, in the embodiments according to FIGS. 23, 24, 26 and 27, these end legs 102*b*, 104*b* can be positioned such that they mesh with the locking depression in areas formed with a curved outer circumferential contour rather than with their obtuse ends.

Figure 28:
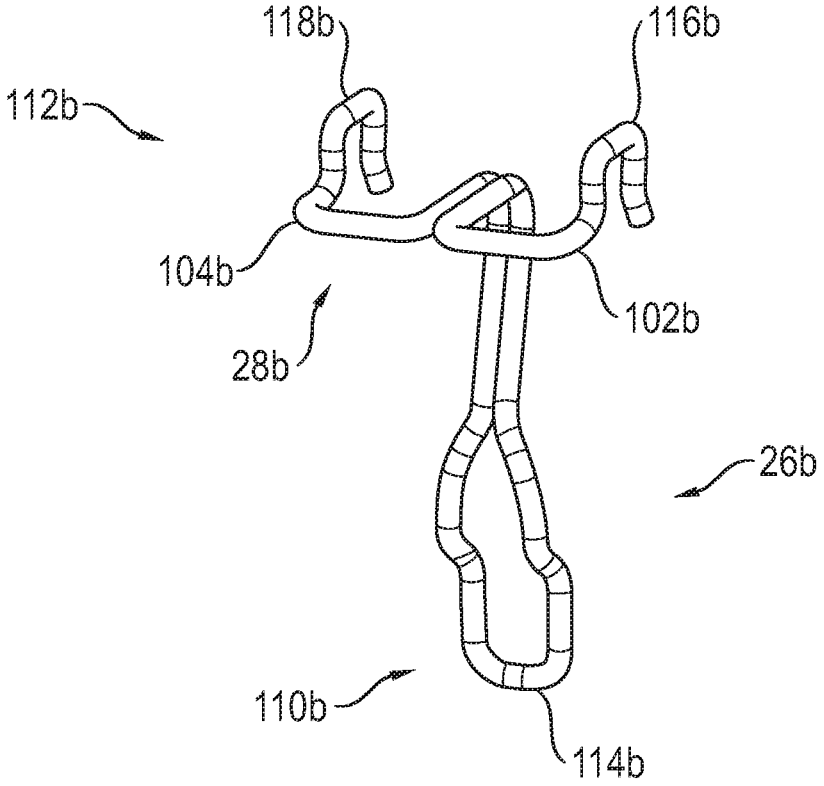
FIG. 28 is a perspective view showing another locking fixing element that can be used in the embodiment according to FIG. 22.

At the locking fixing element 26*b* shown in FIG. 28, the end legs 102*b*, 104*b* may additionally have U-shaped end sections 116*b*, 118*b*, with which they can extend over the axial end of the inner housing 14*b* radially inwards.

FIGS. 29 through 35 show embodiments of a locking fixing device, in which a plurality of locking fixing elements arranged following one another in the circumferential direction are provided as shaped sheet metal parts. Components that corresponds to above-described components in terms of configuration and function are designated with the same reference numbers with the addition of a suffix "c."

Figure 29:
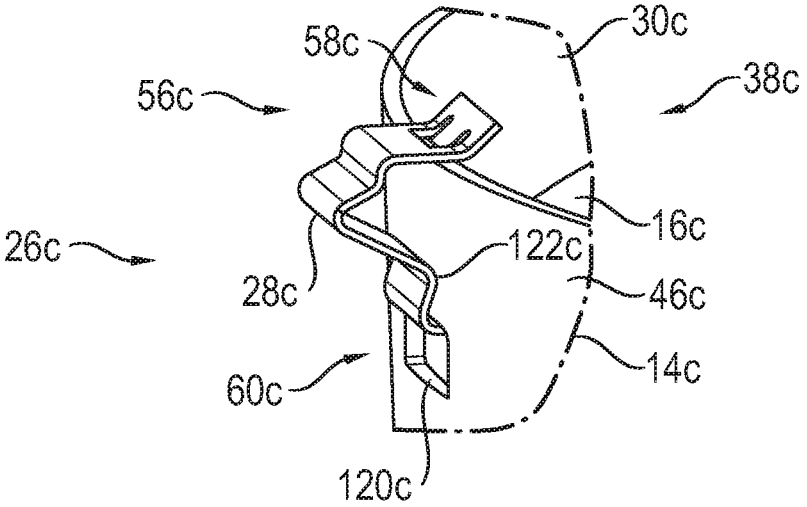
FIG. 29 is a cutaway perspective view showing an alternative embodiment of a locking fixing element that is fixed at an inner housing and is provided as a shaped sheet metal part.
Figure 30:
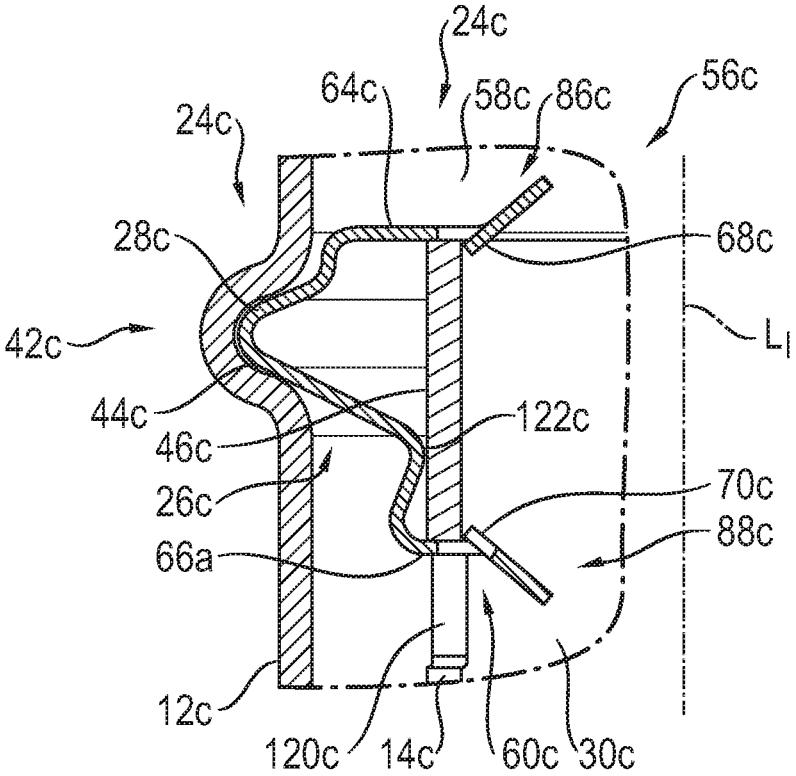
FIG. 30 is a partial sectional view showing an inner housing held by a locking fixing element according to FIG. 29 at an outer housing of an exhaust gas treatment assembly unit.

FIGS. 29 and 30 show a locking fixing element 26*c*, whose holding area 56*c* has two holding sections 58*c*, 60*c* arranged at axially spaced locations with respect to the inner housing longitudinal axis $L_I$. In each of the holding sections 58*c*, 60*c*, the locking fixing element 26*c* extends over and passes through the locking fixing element 26*c* of the inner housing 14*c* from the outer side 46*c* thereof radially inwards. The holding leg 64*c* of the holding section 58*c* extends here over the axial end of the inner housing 14*c* in the axial end area 38*c* and extends behind the inner housing 14*c* on the inner side 30*c* thereof with an axially bent-off holding projection 68*c*.

With its holding leg 66*c*, the locking fixing element 26*c* passes through a passage opening 120*c* in the inner wall 14*c* and extends with a holding projection 70*c* behind the inner housing 14*c* on the inner side 30*c* thereof. The locking fixing element 26*c* provided as a shaped sheet metal part made of a sheet metal material may be shaped basically such that the two holding legs 64*c*, 66*c* are prestressed in the direction towards one another, so that the two holding projections 68*c*, 70*c* are held such that they extend reliably behind the inner housing 14*c* on the inner side 30*c* thereof.

The radially outwards projecting locking meshing area 28*c*, which is positioned such that it meshes with the locking depression 44*c* of the locking receiving area 42*c*, is formed axially between the two holding sections 58*c*, 60*c*. To make it possible to hold the locking meshing area 28*c* such that, prestressed radially outwards, it meshes with the locking depression 44*c*, a support section 122*c* supported radially inwards on the outer side 46*c* of the inner housing 14*c* is formed between the locking meshing area 28*c* and the holding section 60*c*.

If the inner housing 14*c* equipped with such locking fixing elements 26*c* is pushed into the outer housing 12*c*, the locking fixing element 26*c* supported with its support section 122*c* on the outer side 46*c* of the inner housing 14*c* can be displaced radially inwards with its locking meshing area 28*c* based on its inherent elasticity, and the holding leg 64*c* extending radially over the axial end of the inner housing 14*c* can likewise be displaced radially inwards, so that the holding projection 68*c* can temporarily be lifted off from the inner side 30*c* of the inner housing 14*c*. If the locking meshing area 28*c* snaps into the locking depression 44*c* of the locking receiving area 42*c*, this and together with this also the holding leg 64*c* are displaced again radially outwards, so that the holding projection 68*c* can again be in contact in the locked state, for example, with the inner side 30*c* of the inner housing 14*c*.

Figure 31:
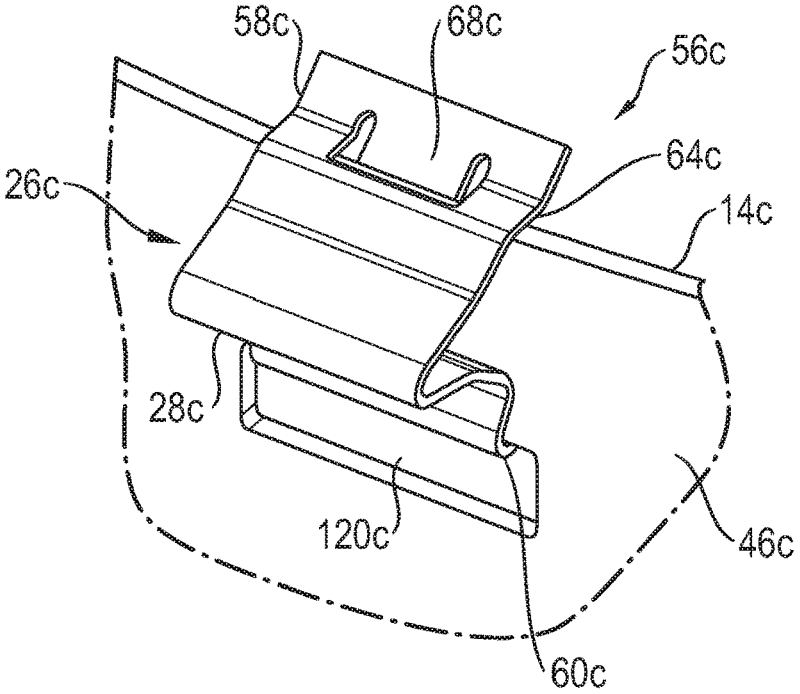
FIG. 31 is a cutaway perspective view showing an alternative embodiment of a locking fixing element held at an inner housing.
Figure 32:
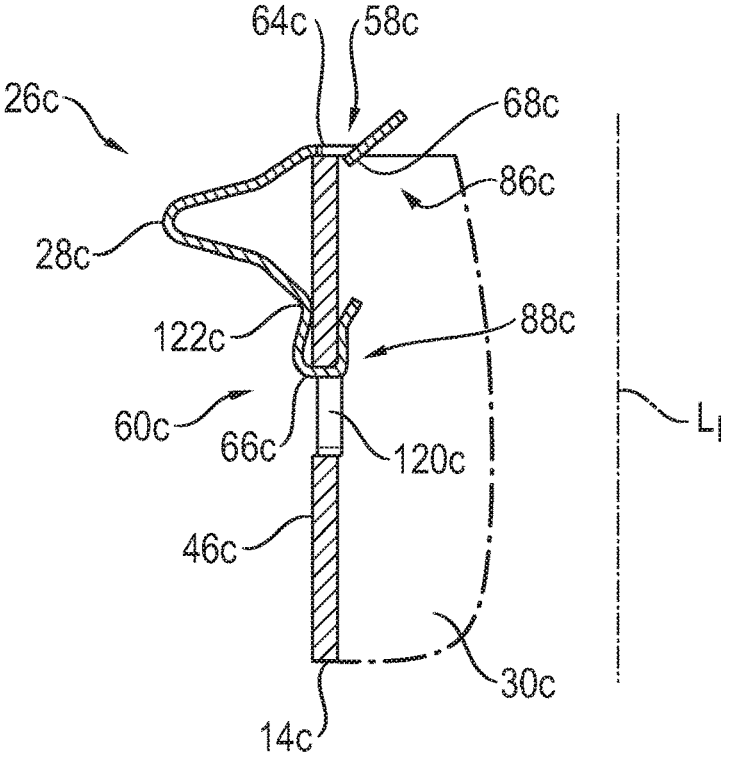
FIG. 32 is a partial longitudinal sectional view of the locking fixing element according to FIG. 31, which is held at the inner housing.
Figure 33:
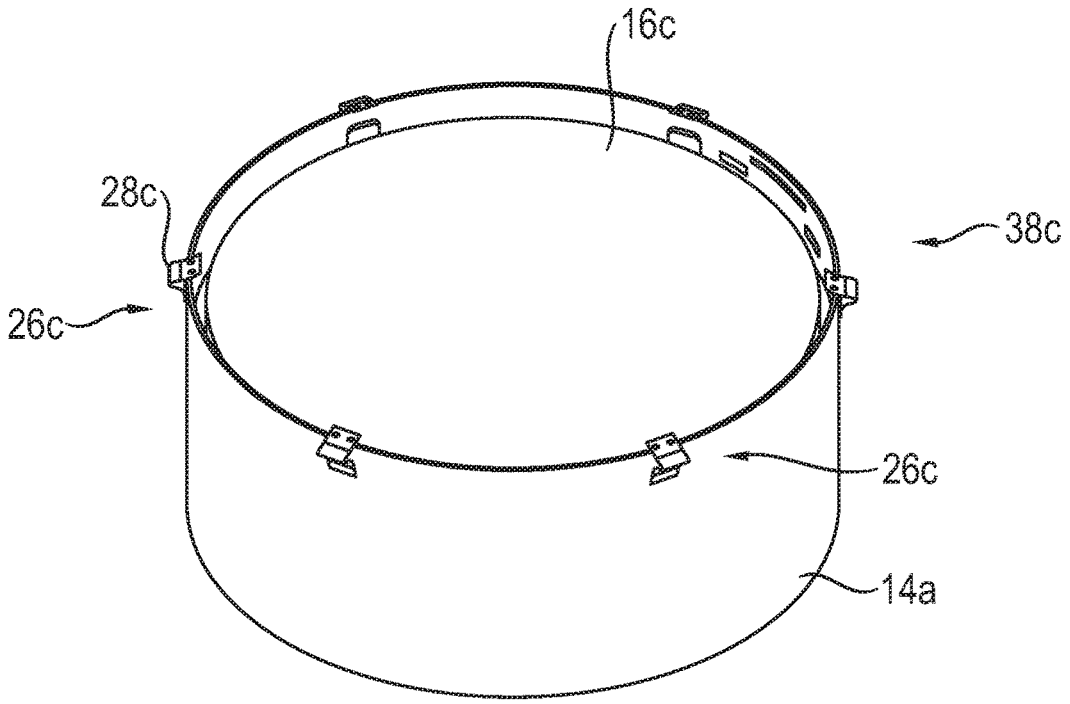
FIG. 33 is a perspective view showing the inner housing with a plurality of locking fixing elements provided as shaped sheet metal parts.

A modified embodiment of a locking fixing element 26*c* is shown in FIGS. 31 through 33. This differs from the embodiment shown in FIGS. 29 and 30 essentially in the shape of the holding section 60*c* passing through the passage opening 120*c* in the inner housing 14*c*. This holding section has an essentially U-shaped or Ω-shaped configuration and extends with its free leg behind the inner housing 14*c* on the inner side 30*c* thereof. FIG. 32 illustrates with mutually overlapping contour lines that the locking fixing element 26*c* is shaped such that the support section 122*c* adjoining the holding section 60*c* is held basically prestressed against the outer side 46*c* of the inner housing 14*c*.

Figure 34:
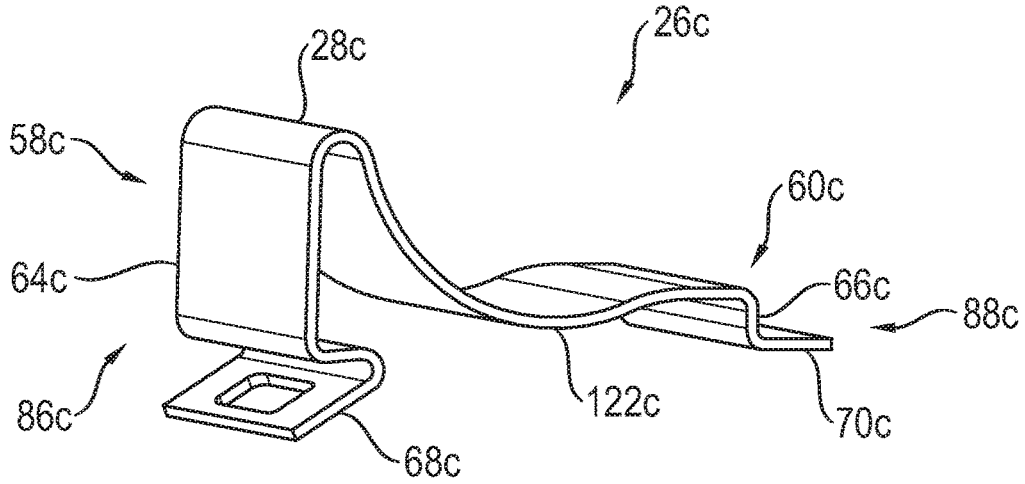
FIG. 34 is a perspective view showing another embodiment of a locking fixing element configured as a shaped sheet metal part.
Figure 35:
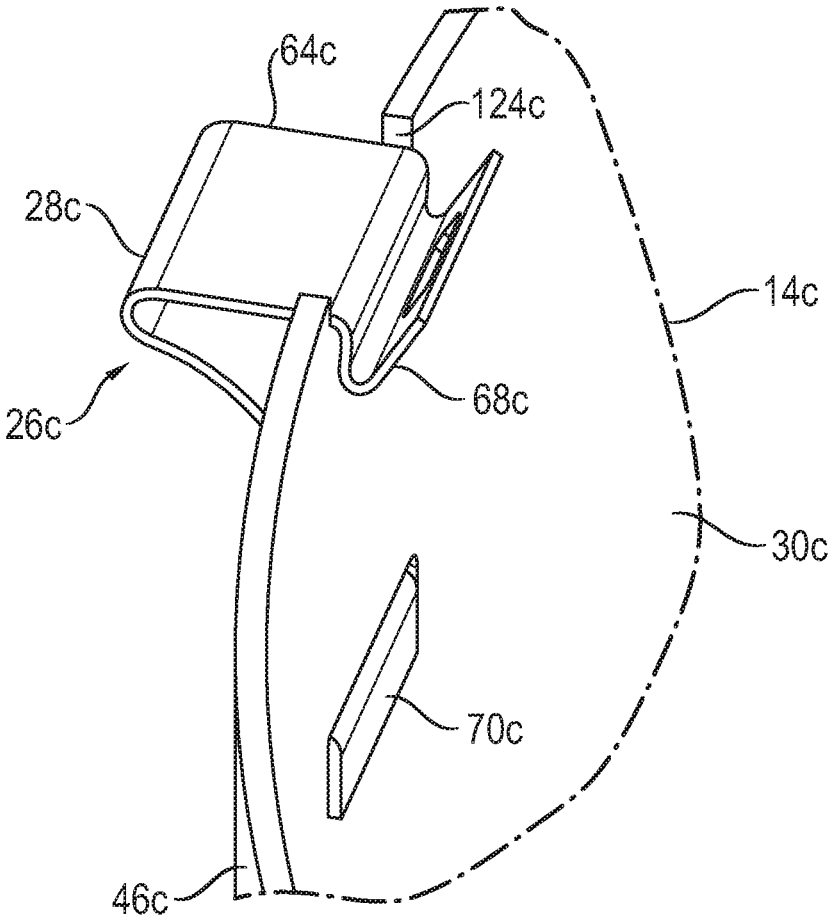
FIG. 35 is a cutaway perspective view showing a locking fixing element according to FIG. 34, which is held at an inner housing of an exhaust gas treatment assembly unit.

Another embodiment of such a locking fixing element 26*c* provided as a shaped sheet metal part is shown in FIGS. 34 and 35. This locking fixing element 26*c* is shaped in its holding section 58*c* such that a holding projection 68*c* having an essentially U-shaped configuration, which extends behind the inner housing 14*c* on the inner side 30*c* thereof, is formed at the holding leg 64*c*. In association with the holding leg 64*c*, an axially open recess 124*c* is provided at the axial end area 38*c* of the inner housing 14*c*.

Adjoining the holding leg 66*c*, a holding projection 70*c*, which is bent in the direction away from the other holding section 58*c* and extends essentially axially, is formed at the holding section 60*c*, and said holding projection 70*c*, being in contact with the inner side 30*c* of the inner housing 14*c*, extends over and behind the inner housing 14*c* and thus forms an abutment for the support section 122*c*, which has an arc-shaped configuration and is in contact with the outer side 46*c* of the inner housing 14*c* and is prestressed against this outer side 46*c*.

The holding elements 86*c*, 88*c* provided essentially by the respective holding legs 64*c*, 66*c* are provided at a respective locking fixing element 26*c* as integral components, i.e., as components configured on one piece of material in the embodiments shown in FIGS. 29-35 as well, in which the locking fixing elements 26*c* are configured as shaped sheet metal parts.

While specific embodiments of the invention have been shown and described in detail to illustrate the application of the principles of the invention, it will be understood that the invention may be embodied otherwise without departing from such principles.

What is claimed is:

1. An exhaust gas treatment assembly unit for an exhaust system of an internal combustion engine, the exhaust gas treatment assembly unit comprising:

a tubular outer housing elongated in a direction of an outer housing longitudinal axis;

a tubular inner housing elongated in a direction of an inner housing longitudinal axis, wherein an exhaust gas treatment unit is carried in the inner housing; and a locking fixing device configured to detachably fix the inner housing in the outer housing, wherein the locking fixing device comprises:

a plurality of locking fixing elements held at the inner housing in both axial directions along the inner housing longitudinal axis, and following one another in a circumferential direction about the inner housing longitudinal axis, each locking fixing element having at least one radially outwards prestressed locking meshing portion; and a locking receiving area associated with each one of the locking meshing portions and interacting with the locking meshing portions for holding the inner housing in the outer housing in at least one of the two axial directions along the housing outer longitudinal axis, wherein:

each one of the locking fixing elements comprises a holding area holding the locking fixing element at the inner housing in both axial directions along the housing longitudinal axis, each one of the locking meshing portions of each one of the locking fixing elements projecting radially outwards with respect to the holding area thereof;

each one of the holding areas comprises two holding sections arranged spaced from one another in the circumferential direction about the inner housing longitudinal axis or along the inner housing longitudinal axis, at least one of the two spaced holding sections comprising a holding element provided integrally at the locking fixing element by an end section of the locking fixing element, which said end section passes through an opening in the inner housing; and the locking receiving area comprises a radially inwardly open locking depression extending in at least some areas in a circumferential direction about the outer housing longitudinal axis.

2. The exhaust gas treatment assembly unit in accordance with claim 1, wherein:

the locking receiving area comprises a groove locking depression extending without interruptions in a circumferential direction about the outer housing longitudinal axis; or the locking receiving area comprises a plurality of locking depressions following one another in the circumferential direction about the outer housing longitudinal axis and arranged at circumferentially spaced locations from one another.

3. The exhaust gas treatment assembly unit in accordance with claim 1, wherein each one of the locking fixing elements comprises a plurality of locking meshing portions spaced from one another in the circumferential direction about the inner housing longitudinal axis.

4. The exhaust gas treatment assembly unit in accordance with claim 1, wherein the locking fixing element is configured as a shaped sheet metal part.

5. The exhaust gas treatment assembly unit in accordance with claim 1, wherein each one of the locking fixing element is fixed by a connection in substance at the inner housing in one holding section.

6. The exhaust gas treatment assembly unit in accordance with claim 1, wherein:

at each one of the holding areas comprising the two holding sections spaced from one another in the direction of the inner housing longitudinal axis, the holding sections extend radially inwards over the inner housing from an outer side thereof and extend behind the inner housing on an inner side thereof, support section provided between the holding sections being supported on the outer side of the inner housing such that the least one locking meshing portion projecting radially outwards for meshing with the associated locking receiving area is provided between the support section and one of the holding sections.

7. The exhaust gas treatment assembly unit in accordance with claim 6, wherein each holding section comprises:

at least one holding leg extending over the inner housing in an area of a passage opening or in the area of an axial end of the inner housing from radially outwards to radially inwards; and a holding projection projecting axially with respect to the holding leg and extending behind the inner housing on the inner side thereof.

8. The exhaust gas treatment assembly unit in accordance with claim 6, wherein the locking fixing element is configured as a shaped sheet metal part.

9. The exhaust gas treatment assembly unit in accordance with claim 1, further comprising mounting material arranged between the inner housing and the outer housing.

10. The exhaust gas treatment assembly unit in accordance with claim 9, wherein:

the locking fixing device acts in an axial end area of the inner housing between the inner housing and the outer housing; and the mounting material is provided at least in another axial end area of the inner housing between the inner housing and the outer housing.

11. The exhaust gas treatment device in accordance with claim 9, wherein:

the mounting material is held under compression between the inner housing and the outer housing; or the mounting material comprises wire material; or the mounting material is held under compression between the inner housing and the outer housing and the mounting material comprises wire material.

12. An internal combustion engine, exhaust system, exhaust gas treatment assembly unit comprising:

a tubular outer housing elongated in a housing longitudinal axis direction;

a tubular inner housing elongated in the housing longitudinal axis direction, wherein the inner housing is configured to carry an exhaust gas treatment unit; and a locking fixing device configured to detachably fix the inner housing in the outer housing, the locking fixing device comprising:

a locking receiving area configured as a radially inwardly open locking depression extending in at least some areas in a circumferential direction with respect to the housing longitudinal axis; and a plurality of single piece locking fixing elements, each of the plurality of fixing elements comprising:

a holding area holding the locking fixing element at the inner housing in both axial directions along the housing longitudinal axis and positioning each locking fixing element to follow another locking fixing element in a circumferential direction about the inner housing longitudinal axis, each holding area comprising two holding sections arranged spaced aprat from one another in the circumferential direction about the inner housing longitudinal axis or spaced from one another along the inner housing longitudinal axis, at least one of the two spaced apart holding sections comprising a holding element provided by an end section of the locking fixing element, said end section passing through an opening in the inner housing; and at least one radially outwards prestressed locking meshing portion, each locking meshing portion acting radially outwards with respect to the holding area thereof and interacting with the open locking depression to hold the inner housing in the outer housing in at least one of the two axial directions along the housing outer longitudinal axis.

* * * * *